US009327156B2

(12) United States Patent
von Hoffmann et al.

(10) Patent No.: US 9,327,156 B2
(45) Date of Patent: May 3, 2016

(54) BIDIRECTIONAL, NEUTRAL BIAS TONING GARMENT

(71) Applicant: Tau Orthopedics, LLC, Coto de Caza, CA (US)

(72) Inventors: Kaitlin von Hoffmann, Sunnyvale, CA (US); Gerard von Hoffmann, Coto de Caza, CA (US)

(73) Assignee: Tau Orthopedics, LLC, Coto de Caza, CA (US)

( * ) Notice: Subject to any disclaimer, the term of this patent is extended or adjusted under 35 U.S.C. 154(b) by 85 days.

(21) Appl. No.: 14/217,576

(22) Filed: Mar. 18, 2014

(65) Prior Publication Data

US 2014/0200121 A1 Jul. 17, 2014

Related U.S. Application Data

(63) Continuation-in-part of application No. 14/192,805, filed on Feb. 27, 2014, now abandoned, which is a continuation-in-part of application No. 12/951,947, filed on Nov. 22, 2010, now Pat. No. 8,986,177, which is a continuation-in-part of application No. 12/797,718, filed on Jun. 10, 2010, now abandoned.

(60) Provisional application No. 61/218,607, filed on Jun. 19, 2009.

(51) Int. Cl.

| | |
|---|---|
| ***A63B 21/02*** | (2006.01) |
| ***A63B 21/00*** | (2006.01) |
| ***A63B 23/04*** | (2006.01) |
| ***A63B 21/018*** | (2006.01) |
| *A63B 21/008* | (2006.01) |
| *A63B 21/055* | (2006.01) |

(Continued)

(52) U.S. Cl.

CPC ..... *A63B 21/00156* (2013.04); *A63B 21/0054* (2015.10); *A63B 21/00061* (2013.01); *A63B 21/00189* (2013.01); *A63B 21/018* (2013.01); *A63B 21/02* (2013.01); *A63B 21/4011* (2015.10); *A63B 21/4017* (2015.10); *A63B 21/4025* (2015.10); *A63B 21/4039* (2015.10); *A63B 23/0482* (2013.01); *A63B 23/0494* (2013.01); *A63B 21/0083* (2013.01); *A63B 21/0087* (2013.01); *A63B 21/023* (2013.01); *A63B 21/0552* (2013.01); *A63B 21/153* (2013.01); *A63B 21/225* (2013.01); *A63B 23/02* (2013.01); *A63B 23/1281* (2013.01); *A63B 2208/14* (2013.01); *A63B 2209/10* (2013.01); *A63B 2220/24* (2013.01); *A63B 2220/34* (2013.01); *A63B 2220/51* (2013.01); *A63B 2225/20* (2013.01); *A63B 2225/50* (2013.01); *A63B 2230/00* (2013.01); *A63B 2230/06* (2013.01); *A63B 2230/50* (2013.01)

(58) Field of Classification Search

USPC ..... 482/1–148

See application file for complete search history.

(56) References Cited

U.S. PATENT DOCUMENTS

| | | | |
|---|---|---|---|
| 2,664,566 | A | 1/1954 | Mianulli |
| 2,832,334 | A | 4/1958 | Whitelaw |

(Continued)

*Primary Examiner* — Stephen Crow

(74) *Attorney, Agent, or Firm* — Gerald von Hoffman; Aurora Consulting Group, LLC

(57) ABSTRACT

Disclosed is a muscle toning garment with detachable, interchangeable resistance elements. The garment provides resistance training throughout an angular range of motion. The garment may be low profile, and worn by a wearer as a primary garment or beneath conventional clothing. Toning may thereby be accomplished throughout the wearer's normal daily activities, without the need for access to conventional exercise equipment. Alternatively, the device may be worn as a supplemental training tool during conventional training techniques.

18 Claims, 19 Drawing Sheets

(51) Int. Cl.

| | |
|---|---|
| *A63B 23/02* | (2006.01) |
| *A63B 23/12* | (2006.01) |
| *A63B 21/22* | (2006.01) |

(56) References Cited

U.S. PATENT DOCUMENTS

| | | | | |
|---|---|---|---|---|
| 4,065,814 | A | 1/1978 | Fox | |
| 4,485,808 | A | 12/1984 | Hepburn | |
| 4,621,620 | A | 11/1986 | Anderson | |
| 4,657,000 | A | 4/1987 | Hepburn | |
| 4,875,677 | A | 10/1989 | Tetreault | |
| 4,910,802 | A | 3/1990 | Malloy | |
| 4,947,835 | A | 8/1990 | Hepburn et al. | |
| 5,052,379 | A | 10/1991 | Airy et al. | |
| 5,176,600 | A | 1/1993 | Wilkinson | |
| 5,201,074 | A | 4/1993 | Dicker | |
| 5,263,923 | A | 11/1993 | Fujimoto | |
| 5,306,222 | A | 4/1994 | Wilkinson | |
| 5,308,305 | A | 5/1994 | Romney | |
| 5,337,737 | A | 8/1994 | Rubin et al. | |
| 5,399,154 | A | 3/1995 | Kipnis et al. | |
| 5,465,428 | A | 11/1995 | Earl | |
| 5,472,412 | A | 12/1995 | Knoth | |
| 5,527,244 | A | 6/1996 | Waller et al. | |
| 5,553,322 | A | 9/1996 | Cebo-Johnson | |
| 5,662,595 | A | 9/1997 | Chesher et al. | |
| 5,685,811 | A | 11/1997 | Mcshane et al. | |
| 5,720,042 | A | 2/1998 | Wilkinson | |
| 5,749,840 | A | 5/1998 | Mitchell et al. | |
| 5,788,618 | A | 8/1998 | Joutras | |
| 5,792,034 | A | 8/1998 | Kozlovsky | |
| RE35,940 | E | 10/1998 | Heinz et al. | |
| 5,867,827 | A | 2/1999 | Wilkinson | |
| 5,875,491 | A | 3/1999 | Wilkinson | |
| 5,937,441 | A | 8/1999 | Raines | |
| 5,960,474 | A | 10/1999 | Dicker et al. | |
| 5,976,063 | A | 11/1999 | Joutras et al. | |
| 5,978,966 | A | 11/1999 | Dicker et al. | |
| 5,993,362 | A | 11/1999 | Ghobadi | |
| 6,176,816 | B1 | 1/2001 | Dicker et al. | |
| 6,186,970 | B1 | 2/2001 | Fujii et al. | |
| 6,210,354 | B1 | 4/2001 | Ousdal | |
| 6,231,488 | B1 | 5/2001 | Dicker et al. | |
| 6,314,580 | B1 | 11/2001 | Greenberg et al. | |
| 6,397,496 | B1 | 6/2002 | Seymour | |
| 6,409,693 | B1 | 6/2002 | Brannigan | |
| 6,440,094 | B1 | 8/2002 | Maas | |
| 6,656,097 | B2 | 12/2003 | Karecki | |
| 6,757,916 | B2 | 7/2004 | Mah et al. | |
| 6,834,752 | B2 | 12/2004 | Irby et al. | |
| 6,872,187 | B1 | 3/2005 | Stark et al. | |
| 6,954,968 | B1 | 10/2005 | Sitbon | |
| 7,048,098 | B1 | 5/2006 | Moradian | |
| 7,087,003 | B1 | 8/2006 | Katterjohn | |
| 7,153,246 | B2 | 12/2006 | Koscielny et al. | |
| 7,235,038 | B2 | 6/2007 | Liao | |
| 7,608,026 | B1 | 10/2009 | Nicassio | |
| 7,652,386 | B2 | 1/2010 | Donelan et al. | |
| 7,659,636 | B2 | 2/2010 | Donelan et al. | |
| 7,682,322 | B2 | 3/2010 | Engelman | |
| 7,744,511 | B2 | 6/2010 | Grigoriev et al. | |
| 7,758,481 | B2 | 7/2010 | Drennan | |
| 7,845,023 | B2 | 12/2010 | Swatee | |
| 7,849,518 | B2 | 12/2010 | Moore et al. | |
| 7,861,319 | B2 | 1/2011 | Torry | |
| 7,874,970 | B2 | 1/2011 | Glisan | |
| 7,931,571 | B2 | 4/2011 | Bernardoni | |
| 7,931,609 | B2 * | 4/2011 | Blanchard | 602/21 |
| 8,043,243 | B2 | 10/2011 | Nathanson et al. | |
| 8,063,644 | B2 | 11/2011 | Rezvani et al. | |
| 8,273,001 | B2 | 9/2012 | Karecki et al. | |
| 8,312,646 | B2 | 11/2012 | Meschter et al. | |
| 8,409,117 | B2 * | 4/2013 | Cheng et al. | 601/5 |
| 8,544,114 | B2 | 10/2013 | Williams et al. | |
| 8,555,415 | B2 | 10/2013 | Bradstreet et al. | |
| 8,663,133 | B2 | 3/2014 | Johnson et al. | |
| 8,663,142 | B1 * | 3/2014 | Pansiera et al. | 602/16 |
| 8,784,350 | B2 * | 7/2014 | Cohen | 602/27 |
| 8,870,798 | B2 * | 10/2014 | Coleman et al. | 602/2 |
| 8,939,924 | B1 * | 1/2015 | Paulos | 602/16 |
| 8,986,177 | B2 * | 3/2015 | von Hoffmann et al. | 482/124 |
| 2001/0029224 | A1 | 10/2001 | Karecki | |
| 2004/0116260 | A1 | 6/2004 | Drennan et al. | |
| 2005/0101887 | A1 | 5/2005 | Stark et al. | |
| 2005/0148915 | A1 | 7/2005 | Nathanson et al. | |
| 2006/0000478 | A1 | 1/2006 | Taylor | |
| 2006/0016649 | A1 | 1/2006 | Gordaninejad et al. | |
| 2006/0046913 | A1 | 3/2006 | Squittieri | |
| 2006/0079825 | A1 | 4/2006 | Hilton et al. | |
| 2006/0096818 | A1 | 5/2006 | Moradian | |
| 2006/0272071 | A1 | 12/2006 | Mickle | |
| 2007/0010772 | A1 | 1/2007 | Ryan | |
| 2007/0016120 | A1 | 1/2007 | Latronica et al. | |
| 2007/0032359 | A1 | 2/2007 | Toronto | |
| 2007/0100265 | A1 | 5/2007 | Gamada | |
| 2007/0123997 | A1 | 5/2007 | Herr et al. | |
| 2007/0135279 | A1 | 6/2007 | Purdy et al. | |
| 2008/0026917 | A1 | 1/2008 | Campana | |
| 2008/0108918 | A1 | 5/2008 | Joutras et al. | |
| 2009/0253325 | A1 | 10/2009 | Brookstein et al. | |
| 2010/0041527 | A1 | 2/2010 | Miller | |
| 2010/0075557 | A1 | 3/2010 | Shteiyer | |
| 2010/0077527 | A1 | 4/2010 | Lee et al. | |
| 2010/0144490 | A1 | 6/2010 | Purdy et al. | |
| 2010/0223717 | A1 | 9/2010 | Foy et al. | |
| 2010/0248915 | A1 | 9/2010 | Gibson-Horn | |
| 2010/0267525 | A1 | 10/2010 | Tanner | |
| 2011/0010001 | A1 | 1/2011 | Chung et al. | |
| 2011/0111932 | A1 | 5/2011 | Von Hoffmann et al. | |
| 2011/0126335 | A1 | 6/2011 | Schultz | |
| 2011/0224585 | A1 | 9/2011 | Hall | |
| 2011/0231986 | A1 | 9/2011 | Waldie et al. | |
| 2012/0225755 | A1 | 9/2012 | Lloyd | |
| 2013/0085040 | A1 | 4/2013 | Bowers | |
| 2013/0130874 | A1 | 5/2013 | Richardson et al. | |
| 2013/0150218 | A1 | 6/2013 | Mial | |
| 2013/0190147 | A1 | 7/2013 | Luo et al. | |
| 2013/0247330 | A1 | 9/2013 | Daul et al. | |
| 2013/0298301 | A1 | 11/2013 | Petrakis et al. | |
| 2014/0109282 | A1 | 4/2014 | White et al. | |
| 2014/0173934 | A1 | 6/2014 | Bell | |
| 2014/0200121 | A1 | 7/2014 | von Hoffmann et al. | |
| 2014/0207030 | A1 | 7/2014 | Hall | |
| 2014/0336020 | A1 | 11/2014 | von Hoffman et al. | |
| 2015/0190669 | A1 | 7/2015 | Matsuura et al. | |
| 2015/0258360 | A1 | 9/2015 | von Hoffman et al. | |
| 2016/0038783 | A1 | 2/2016 | Matsuura et al. | |

* cited by examiner

BIDIRECTIONAL, NEUTRAL BIAS TONING GARMENT

CROSS-REFERENCE TO RELATED APPLICATIONS

This application is a continuation in part of U.S. patent application Ser. No. 14/192,805 filed Feb. 27, 2014, which is a continuation-in-part of U.S. patent application Ser. No. 12/951,947, filed on Nov. 22, 2010, which is a continuation-in-part of U.S. patent application Ser. No. 12/797,718, filed on Jun. 10, 2010 which claims the benefit of U.S. Provisional Application No. 61/218,607, filed Jun. 19, 2009, the entirety of these applications are hereby incorporated by reference herein.

BACKGROUND OF THE INVENTION

Resistance training, sometimes known as weight training or strength training, is a specialized method of conditioning designed to increase muscle strength, muscle endurance, tone and muscle power. Resistance training refers to the use of any one or a combination of training methods which may include resistance machines, dumbbells, barbells, body weight, and rubber tubing.

The goal of resistance training, according to the American Sports Medicine Institute (ASMI), is to "gradually and progressively overload the musculoskeletal system so it gets stronger." This is accomplished by exerting effort against a specific opposing force such as that generated by elastic resistance (i.e. resistance to being stretched or bent). Exercises are isotonic if a body part is moving against the force. Exercises are isometric if a body part is holding still against the force. Resistance exercise is used to develop the strength and size of skeletal muscles. Full range of motion is important in resistance training because muscle overload occurs only at the specific joint angles where the muscle is worked. Properly performed, resistance training can provide significant functional benefits and improvement in overall health and well-being.

Research shows that regular resistance training will strengthen and tone muscles and increase bone mass. Resistance training should not be confused with weightlifting, power lifting or bodybuilding, which are competitive sports involving different types of strength training with non-elastic forces such as gravity (weight training or plyometrics) an immovable resistance (isometrics, usually the body's own muscles or a structural feature such as a door frame).

Whether or not increased strength is an objective, repetitive resistance training can also be utilized to elevate aerobic metabolism, for the purpose of weight loss.

Resistance exercise equipment has therefore developed into a popular tool used for conditioning, strength training, muscle building, and weight loss. Various types of resistance exercise equipment are known, such as free weights, exercise machines, and resistance exercise bands or tubing. Various limitations exist with the prior art exercise devices. For example, many types of exercise equipment, such as free weights and most exercise machines, are not portable. With respect to exercise bands and tubing, they may need to be attached to a stationary object, such as a closed door or a heavy piece of furniture, and require sufficient space. This becomes a problem when, for example, the user wishes to perform resistance exercises in a location where such stationary objects or sufficient space are not readily found. Resistance bands are also limited to a single resistance profile in which the amount of resistance changes as a function of angular displacement of the joint under load. This may result in under working the muscles at the front end of a motion cycle, and over working the muscles at the back end of the cycle. Conventional elastic devices also provide a unidirectional bias that varies in intensity throughout an angular range but not in direction. Such devices thus cannot work both the flexor and extensor muscles of a given motion segment without adjustment.

A need therefore exists for resistance based wearable toning equipment that may be used on its own without the need to employ other types of equipment, and that applies a relatively constant load throughout both a flexion and extension range of motion.

SUMMARY OF THE INVENTION

There is provided in accordance with one aspect of the present invention, a low profile, wearable, dynamic resistance toning device. The dynamic resistance device comprises a waistband, for attachment around the waist of a wearer. A left leg and right leg superior leg attachment structures are provided, for attachment to a leg of the wearer in between the waistband and the wearer's knee. A left leg and right leg inferior leg attachment structures are provided, for attachment to the leg of the wearer below the knee.

At least one left leg resistance panel and at least one right leg resistance panel extends between the waistband and the corresponding inferior leg attachment structures. The resistance panel impart bidirectional resistance to movement throughout a range of motion.

The resistance panel may comprise a malleable metal. The metal may comprise copper. The resistance panel may comprise a plurality of malleable strands, typically extending in an inferior-superior direction in an as worn orientation. The plurality of malleable strands may be woven into a fabric. The sum of the cross-sectional areas of all the strands, taken in a transverse cross-section through the strands in between the waist and the superior leg attachments is typically within the range of from about 0.020 and about 0.060 square inches, per inch of the resistance panel measured in a circumferential direction around the leg for each leg. Alternatively, or in addition, each resistance panel may comprise a pivotable resistance element.

In one implementation of the invention, the superior attachment structures and inferior attachment structures comprise first and second regions of a garment. The dynamic resistance device may impose a first level of resistance to movement across the hip, and a second level of resistance across the knee, where the first level is greater than the second level. Each of a left and right resistance panels may impose a resistance to movement to at least about 10 foot pounds in between the waist and the superior attachment structure. In some implementations of the invention, the device imposes a resistance to movement at the hip of at least about 10 foot pounds, and resistance of movement at the knee of at least about 5 foot pounds, for each of the right and left legs.

There is provided in accordance with one aspect of the present invention, a detachable component toning garment. The garment comprises a waist portion, a left leg portion and a right leg portion. An anterior attachment structure extends in an inferior-superior direction on each of the right and left leg. A posterior attachment structure extending in an inferior-superior direction is provided on each of the right and left leg, spaced apart from the anterior attachment structure. The anterior and posterior attachment structures are configured to removably secure a left and right resistance element to each of the left and right legs, respectively.

In one implementation of the invention, the anterior and posterior attachment structures comprise a portion of a zipper. The zipper may be a toothless zipper, or may comprise a plurality of projections or teeth configured to interdigitate with a corresponding zipper portion on a detachable resistance element.

The anterior and posterior attachment structures on each of the right and left legs are preferably within the range of from about 0.5 inches to about 8 inches apart from each other. Generally, the anterior and posterior attachment structures are within the range of from about 1.5 inches and about 5 inches apart from each other. The anterior and posterior attachment structures on each leg are generally parallel to each other, and positioned on either side of the midline of the leg, measured in the anterior-posterior direction.

There is provided a resistance element for combination with a detachable component toning garment. The resistance element comprises an elongate flexible body, having a longitudinal axis, a thickness of no more than about 0.5 inches, a width between a first side and a second side of at least about 1.0 inches and a length of at least about 12 inches.

A first zipper half extends in parallel to the longitudinal axis along the first side, and a second zipper half extends in parallel to the longitudinal axis along the second side. The body includes at least one non-fabric element, to resist bending of the body.

The average thickness of the body excluding the zippers is preferably no more than about 0.25 inches, and, in some embodiments no more than about 0.125 inches.

The body may comprise a fabric, having a plurality of metal strands. The body comprises a width of no more than about 5 inches, preferably no more than about 4 inches, and in some embodiments between about 1½ and 2½ inches, measured from the outer limit of the first zipper half to the second zipper half.

The body may comprise a length of at least about 18 inches, and, in some embodiments, at least about 24 inches.

The first and second zipper halves on the resistance element are configured for releasable engagement with complementary zipper halves secured to a detachable component toning garment. The resistance element may comprise a plurality of metal strands, extending substantially parallel to the longitudinal axis. Alternatively, the resistance element may comprise a plurality of segments that are deflectable with respect to each other. The plurality of segments may include a central lumen with a pull wire extending therethrough, to place the segments under compression.

Further features and advantages of the present invention will become apparent to those of skill in the art in view of the detailed description of preferred embodiments which follows, when considered together with attached drawings and claims.

DETAILED DESCRIPTION OF THE PREFERRED EMBODIMENT

Figure 1:
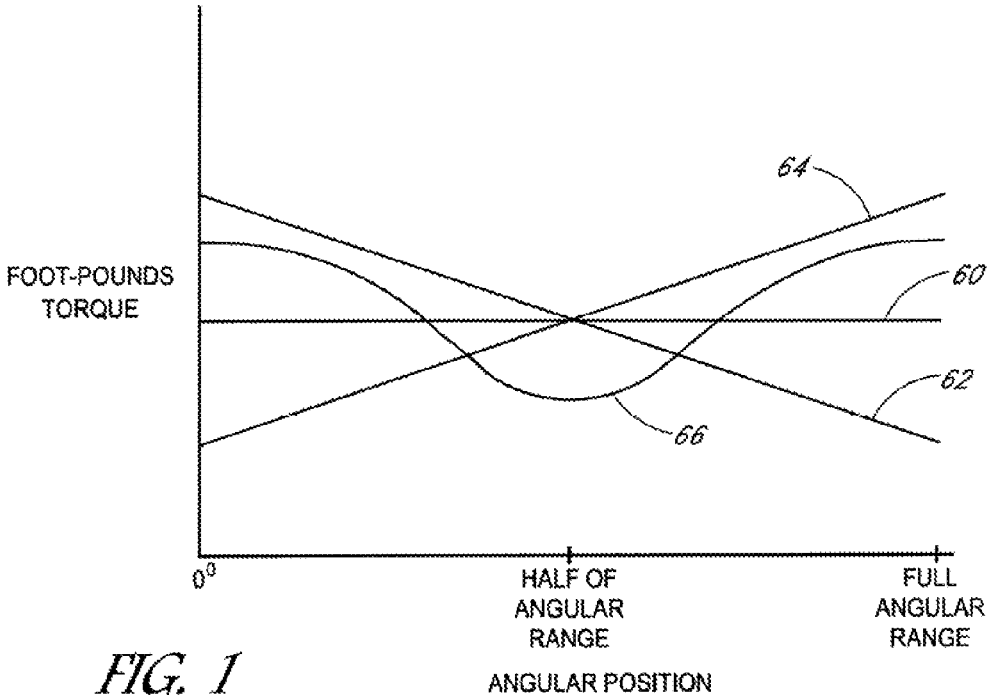
FIG. 1 is a plot of different resistance profiles as a function of angular rotation of a joint.

Detailed descriptions of the preferred embodiments are provided herein. It is to be understood, however, that the present invention may be embodied in various other forms.

Therefore, specific details disclosed herein are not to be interpreted as limiting, but rather as a basis for the claims and as a representative basis for teaching one skilled in the art to employ the present invention in virtually any appropriately detailed system, structure or manner.

The knee joint is a uni-axial hinge joint. The knee moves in a flexion (bending of the knee) and extension (straightening of the knee) direction. The three major bones that form the knee joint are: the femur (thigh bone), the tibia (shin bone), and the patella (kneecap). The prime muscle movers of the knee joint are the quadriceps muscles (on top of the femur), which move the knee into extension; and the hamstring muscles (underneath the femur), which move the knee into flexion. The quadriceps muscles are made up of five muscles known as the rectus femoris, vastus lateralis, vastus medialis, vastus intermedius and a secondary muscle, the vastus medialis oblique (VMO). The hamstring is made up of three muscles known as the biceps femoris, semimembranosus, and semitendinosus. The hamstring to quadriceps muscle strength ratio is two-thirds; meaning, the hamstring is normally approximately thirty-three percent weaker than the quadriceps. The muscles, ligaments, nervous system, and skeletal system work in unison to stabilize the knee during gait activities (walking, running, jumping).

In general, the devices in accordance with the present invention are designed to provide resistance to motion between a first region and a second region of the body such as across a simple or complex joint, throughout an angular range of motion. The resistance can be either unidirectional, to isolate a single muscle or muscle group, or preferably bidirectional to exercise opposing muscle pairs or muscle groups. Optionally, the device will be user adjustable to select uni or bidirectional resistance.

In the example of a device to apply a load under motion across the knee, configured to train quadriceps, the device imposes resistance to extension of the lower leg at the knee joint and throughout the angular range of motion for the knee. During flexion (movement in the return direction) the device may be passive without providing any resistance to movement. Alternatively, in a bidirectional device, the device imposes resistance throughout both extension and flexion in this example to train both the quadriceps and the hamstring muscles. The resistance to flexion and extension may be equal, or may be dissimilar, depending upon the objective of the exercise.

The devices in accordance with the present invention may also be provided with a user adjustable load or resistance.

In one implementation of the invention, the device provides passive resistance to motion throughout an angular range. At any stationary point within the range, the device imposes no bias. Rather the device merely resists movement in either one or both of flexion and extension.

In one mode of operation, the device is worn over an extended period of time wherein the activities of the wearer are dominantly aerobic as distinguished from anaerobic (i.e. dominantly non-anaerobic). The invention may be practiced where some of the activities are of an anaerobic nature, depending upon the training objective of the wearer. The extended period of time could be as short as one hour or less but is preferably at least two hours and sometimes at least eight hours, although it could also be at least about four hours or six hours or more.

The present invention is intended primarily for use to build strength under conditions which favor aerobic metabolism, which will as a necessary consequence be accompanied by an elevated consumption of body fat. Thus the present invention may also comprise methods of achieving weight loss, by wearing one or two or more passive resistance devices for an extended period of time (disclosed elsewhere herein) each day for at least two or three or four or five or more days per week. The present invention also contemplates methods of reducing percent body fat via the same method steps.

Yet other embodiments of the present invention include biometric sensors and electronic data storage and/or wireless data export to a remote receiver such as a smartphone or other wireless device. In some embodiments, the sensors detect electrical signals which are related to the load being transmitted by the force modifying apparatus, the angular position of the upper leg attachment relative to the lower leg attachment, and/or the angular velocity of the upper leg attachment relative to the lower leg attachment, temperature, pulse or other data of interest.

Various dimensions and materials are described herein. It is understood that such information is by example only, and is not limiting to the inventions.

The angular range of motion permitted by the dynamic joint 54 may be within the range of from about 0° (straight leg) to about 145° or more. Typically, an angular range of motion between about 0 and about 45 or 55° is sufficient for a joint such as the knee.

A bi-directional exercise device provides resistance to movement in both the flexion and extension directions. However, the level of resistance may differ. For example, in a normal knee, the ratio of the natural strength of a hamstring to a quadricep is roughly 1:3. A balanced passive resistance device may therefore impose 1 lb of resistance on flexion for every 3 lbs. of resistance on extension. However, for certain athletic competitions or other objectives, the wearer may desire to alter the basic strength ratio of the unexercised hamstring to quadricep. So for example, the passive exercise device 20 may be provided with a 2 lb. resistance on flexion for every 3 lb. resistance on extension or other ratio as may be desired depending upon the intended result.

In any of the embodiments disclosed herein, whether mechanical braces, fabric garments or hybrids, the resistance to movement will be relatively low compared to conventional weight training in view of the intended use of the apparatus for hours at a time. Anaerobic metabolism may be elevated by repetitively placing a minor load on routine movement over an extended period. The load will generally be higher than loads placed by normal clothing and technical wear, and preselected to work particular muscle groups. Preferably, the resistance elements may be adjusted or interchanged with other elements having a different resistance, or additive so that adding multiple resistance elements can increase the net resistance in a particular resistance zone.

The specific levels of resistance will vary from muscle group to muscle group, and typically also between flexion and extension across the same muscle group. Also wearer to wearer customization can be accomplished, to accommodate different training objectives. In general, resistances of at least about 0.5, and often at least about 1 or 2 or 3 or more foot-pounds will be used in most applications on both flexion and extension. Devices specifically configured for rehabilitation following injury (traumatic injury or surgical procedure) may have lower threshold values as desired. Across the hip or knee, resistance against extension in healthy patients will often be within the range of from about 2 to about 75 foot-pounds, more commonly within the range of from about 2 to about 25 foot-pounds, such as at least about 5, 7.5, 10 or 15 foot-pounds. Resistance against flexion will typically be less, such as within the range of from about 1 to about 50 foot-pounds, and often within the range of from about 2 to about 25 foot-pounds. Values of at least about 5, 7.5 or 10 foot pounds may be appropriate depending upon the wearer's objectives.

The resistance to extension might be at least about 130%, sometimes at least about 150% and in some embodiments at least about 200% of the resistance to the corresponding flexion.

The resistance garment may impart any of a variety of resistance profiles, as a function of angular displacement of the joint. For example, FIG. 1 schematically and qualitatively illustrates the units such as pounds of resistance to movement in either or both an extension or flexion direction, as a function of the angular deviation of the joint across a dynamic motion range. In this illustration, an angle of zero may represent a limb in a "start" or straight or other reference configuration, while the midpoint of the range of motion is half way through the range of motion of the target join or motion segment. The maximum range of motion is the maximum normal range for the target joint.

Referring to plot 60, there is illustrated an example in which the resistance to movement is constant throughout the angular range of motion, as a function of angle. Thus, at whatever point the distal extremity may be throughout the angular range of motion with respect to the proximal anatomy, incremental motion encounters the same resistance as it would at any other point throughout the angular range of motion. If motion stops, the resistance stops and there is no net bias or force applied by the device against the distal extremity.

Alternatively, referring to plot 62, there is illustrated the force curve relating to a dynamic joint in the garment in which the resistance to motion is greatest at the beginning of deviation from a starting point, and the resistance to motion falls off to a minimum as the distal extremity reaches the limit of its angular range.

Referring to plot 64, the garment imposes the least resistance at the beginning of bending the limb from the starting point, and the force opposing motion increases as a function of angular deviation throughout the range of motion. This may be utilized, for example, to emphasize building strength on the back half or back portion of an angular range of motion.

As a further alternative, referring to plot 66, the garment may be configured to produce the most strength at the end points of the range of motion, while deemphasizing a central portion of the range of motion. Although not illustrated, the inverse of the plot 66 may additionally be provided, such that the end points in either direction of the angular range of motion across a joint are deemphasized, and strength throughout the middle portion of the range of motion is emphasized.

As will be apparent to those of skill in the art, any of a variety of resistance profiles may be readily constructed, depending upon the desired objective of the training for a particular athlete or rehabilitation protocol.

Figure 2:
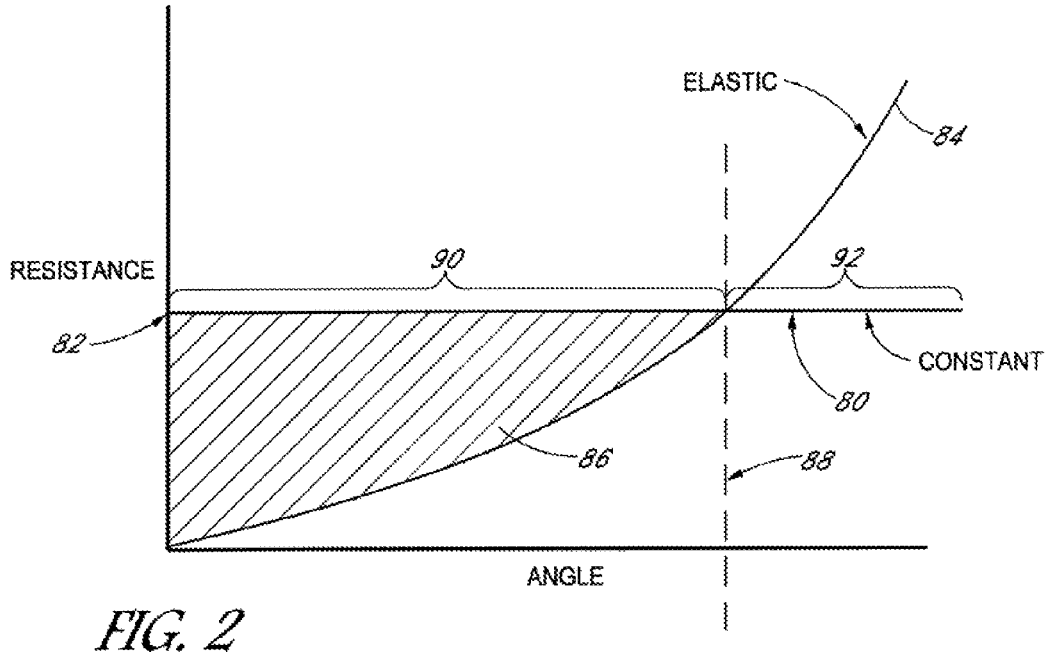
FIG. 2 illustrates a comparison in muscle loading throughout an angular range for a constant resistance device and an elastic resistance device.

Referring to FIG. 2, there is illustrated a qualitative relationship between a constant and an elastic resistive force, throughout a range of motion. The constant force line 80 remains essentially unchanged as a function of angular displacement from any starting point. So the work required to move in opposition to the resistance is at its predetermined value 82 starting at the beginning of any movement within the range, throughout both an early cycle 90 and a late cycle 92.

In contrast, extension (or flexion) throughout an angular range against an elastic resistive force encounters a variable resistance which starts low and increases as a function of the angle of displacement. This elastic resistive force is represented by line 84. Throughout an early cycle 90, resistance may be less than the predetermined value 82 until the elastic has been sufficiently loaded that the elastic resistance curve 84 crosses the predetermined value 82 of the constant resistance line 80 at a transition 88. Only angular displacement within the late cycle 92 encounters resistance at or above the predetermined value 82.

The angle zero can be any reference point throughout the walking cycle, such as standing straight up, or with the leg at the most posterior part of the stride, wherever the elastic has been designed to provide neutral (zero) bias. The shaded area 86 represents work that would be accomplished under the constant resistance device, but would not be accomplished during the early cycle 90 for the elastic device as the elastic is loading and resistance is climbing. Thus the constant resistance device forces work throughout the angular range, while never exceeding a predetermined maximum resistance force, but the elastic may provide inadequate resistance throughout the early cycle 90. This is important because strength is best developed throughout the range of motion that is actually exercised under load, so elastic mechanisms may inadequately load the muscles in the early cycle 90. The shaded area 86 thus represents the inefficiency in an elastic resistance system compared to a constant resistance system.

Early cycle loading in an elastic model can be elevated by pre-tensioning the elastic so that at angle zero the resistance is already up to the reference value 82. But the device now has lost its neutral bias resting position and at all angles throughout the cycle the wearer will be fighting a bias which may be undesirable. In addition, pre-tensioning the elastic will also elevate resistance throughout the late cycle 92 potentially above what the wearer can tolerate or at least sufficiently that the wearer will simply shorten their stride to avoid the resistance spike. Thus maintaining resistance within a range of at least a threshold minimum and a maximum throughout the angular range of motion is preferred. The maximum will generally be less than about 3×, generally less than about 2× the minimum, and in different settings no more than about 80%, 50%, 25%, 10% or 5% or 2% greater than the minimum. In general, substantially constant resistance means plus or minus no more than about 10% from the average resistance throughout the working range.

Figure 3:
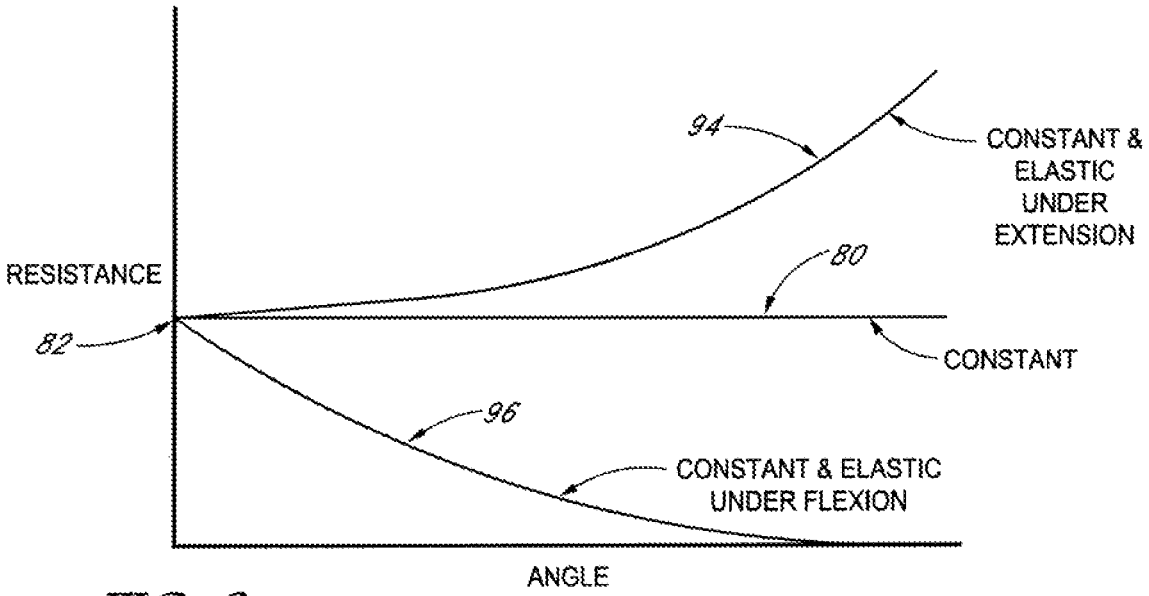
FIG. 3 illustrates a comparison in muscle loading throughout an angular range for a hybrid resistance device having a constant resistance component and an elastic resistance component.

Referring to FIG. 3, the performance of a hybrid garment is illustrated, in which both a constant resistance component and an elastic component are present. This might be accomplished, in the copper rod example described below, by securing one or more spring wire elements (stainless steel, NiTinol or other elastic metals or polymers known in the art) in parallel with the passive resistive element. Bending across the joint thus both bends the passive component as well as the spring or elastic component.

Thus the net force curve on, for example, extension is illustrated as 94 and represents the sum of the resistance from the passive and elastic components assuming the elastic component is configured to be fully relaxed at the reference angle zero. However, under flexion, the elastic component assists flexion in opposition to the resistance from the passive component, producing a curve more like 96 in which resistance to flexion climbs as the angular deviation returns to the reference point. Hybrid elastic/passive configurations can be used where a different resistance profile is desired for flexion compared to extension across a particular motion segment.

In any of the foregoing embodiments, it may be desirable to provide a release which disengages the resistance to movement upon an abrupt increase in force from the wearer. The release may be in the form of a releasable detent or interference joint which can be opened by elastic deformation under force above a preset threshold which is set above normally anticipated forces in normal use. If a wearer should stumble, the reflexive movement to regain balance will activate the release and eliminate resistance to further movement, as a safety feature.

Figure 4:
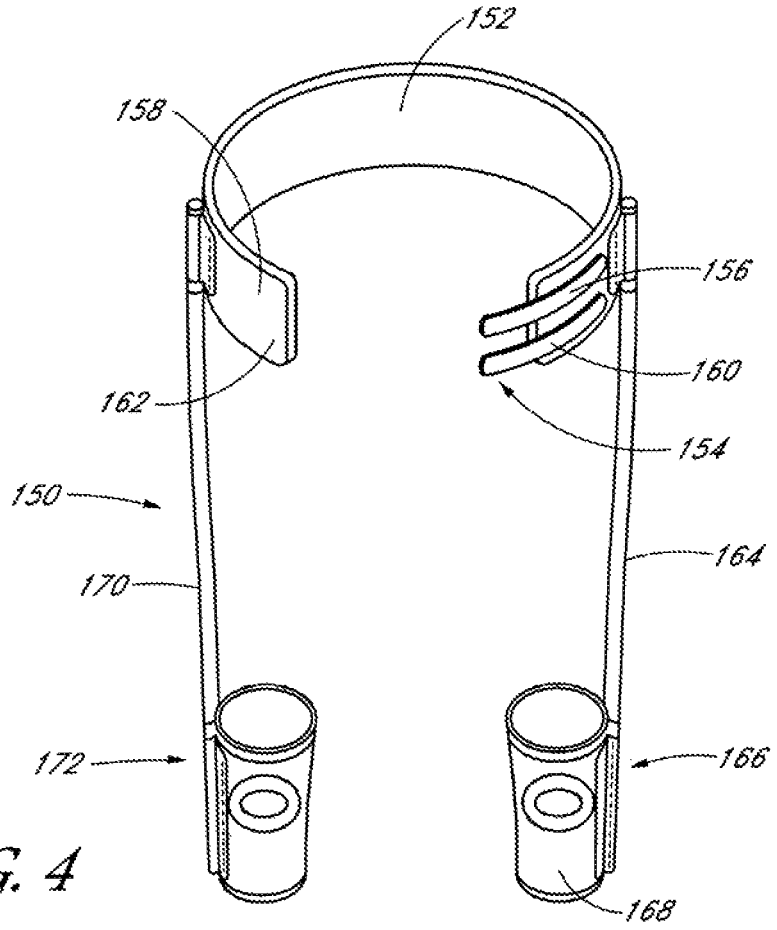
FIG. 4 is a front perspective view of an exercise device in accordance with the present invention, for providing resistance to movement at the hip.

Resistance exercise devices in accordance with the present invention may also be configured for use with larger muscle groups or more complex muscle sets, such as the exercise device illustrated in FIG. 4 which is adapted for providing resistance to movement at the hip. The exercise device 150 comprises a superior attachment structure such as a waistband 152 for encircling the waist of the wearer. Waistband 152 if provided with a closure structure 154, such as at least a first attachment structure 156 and optionally a second attachment structure 160. First attachment structure 156 and second attachment structure 160 cooperate with corresponding attachment structures 158 and 162 to enable secure closure of the waistband 152 about the waist of the wearer, in an adjustable manner. Any of a variety of closure structures such as belts, buckles, hook and loop or Velcro strips, snaps, or others disclosed elsewhere herein may be utilized.

A first (left) resistance element 164 is secured to the waistband 152 and extends across the hip to a first inferior attachment structure 166. The first inferior attachment structure 166 may comprise any of a variety of structures for securing the first resistance element 164 to the wearer's leg. As illustrated, the first inferior attachment structure 166 is in the form of a cuff 168, adapted to surround the wearer's knee. The cuff 168 may alternatively be configured to surround the wearer's leg above or below the knee, depending upon the desired performance characteristics. Cuff 168 may be provided with an axial slit for example running the full length of the medial side, so that the cuff may be advanced laterally around the wearer's leg, and then secured using any of a variety of snap fit, Velcro or other adjustable fasteners. Alternatively, the cuff 168 may comprise a stretchable fabric cuff, that may be advanced over the wearer's foot and up the wearer's leg into position at the knee or other desired location.

As will be apparent from FIG. 4, the exercise device 150, as worn, will provide resistance to movement at the hip in an amount that depends upon the construction of first resistance element 164. First resistance element 164 may comprise any of a variety of structures or fabrics which provide resistance to movement, as have been described elsewhere herein. In one embodiment, first resistance element 164 comprises one or more elongate elements such as a rod or bar of homogeneous bendable material. In one embodiment, the first resistance element comprises one or more elongate copper rods, having a diameter within the range of from about 0.125 or 0.25 inches to about 0.75 inches. As the wearer advances a leg forward from a first, neutral position to a second, forward position, the rod bends to provide resistance. The malleable nature of this material causes the force to stop once the leg has reached the second, forward position. As the leg is brought rearwardly from the second, forward position, the rod again bends, providing resistance to movement in the opposite direction. This resistance may be considered passive, and the rod exerts no directional bias in the absence of motion by the wearer.

Alternatively, the first resistance element 164 may comprise a material which provides an active bias in any predetermined direction. For example, a rod or coil spring comprising a material such as spring steel, Nitinol, or a variety of others known in the art, will provide zero bias in its predetermined neutral position. However, any movement of the wearer's leg from the predetermined zero position will be opposed by a continuous and typically increasing bias. Thus, even when the wearer's leg is no longer in motion, the first resistance element 164 will urge the wearer's leg back to the preset zero position.

The exercise device 150 is preferably bilaterally symmetrical, having a second resistance element 170 and a second inferior attachment 172 formed essentially as a mirror image of the structure described above.

The bending characteristics of the first resistance element near the attachment to the belt may be optimized by providing a first tubular support concentrically disposed over a second tubular support in a telescoping relationship which is concentrically disposed over the first resistance element 164. This structure enables control of the flexibility characteristics and moves the bending point inferiorly along the length of the first resistance element 164.

The first and second resistance elements 164 and 170 can be provided in a set of graduated resistance values such as by increasing cross-sectional area, or by increase in the number of resistance elements 164. Thus, the belt can be configured to support a first, second and third tubular support elements for receiving a first, second and third resistance element 164. One or two or three or four or more resistance elements may be provided, depending upon the construction of the resistance element as will be apparent to those of skill in the art in view of the disclosure herein.

At least a right and a left safety release may be provided, to release the resistance from the right and left resistance elements in response to a sudden spike in force applied by the wearer such as might occur if the wearer were to try to recover from missing a step or tripping. The release may be configured in a variety of ways depending upon the underlying device design. For example, in a solid flexible rod resistance element, a short section of rod may be constructed of a different material which would snap under a sudden load spike. That resistance element would be disposed and replaced once the release has been actuated. Alternatively, a male component on a first section of the resistance element can be snap fit with a female component on a second section of the resistance element, such that the two components become reversibly disengaged from each other upon application of a sudden force above the predetermined safety threshold. Two components can be pivotable connected to each other along the length of the resistance element, but with a coefficient of static friction such that movement of the pivot is only permitted in response to loads above the predetermined threshold. Alternatively, one or more of the belt connectors or corresponding inferior connectors can be releasably secured with respect to the wearer. Any of a variety of interference fit attachment structures or hook and loop fasteners can be optimized to reversibly release upon application of the threshold pressure. In more complex systems or systems configured for relatively high resistance such as for heavy athletic training, more sophisticated release mechanisms may be configured such as those used in conventional ski bindings and well understood in the art.

Figure 5:
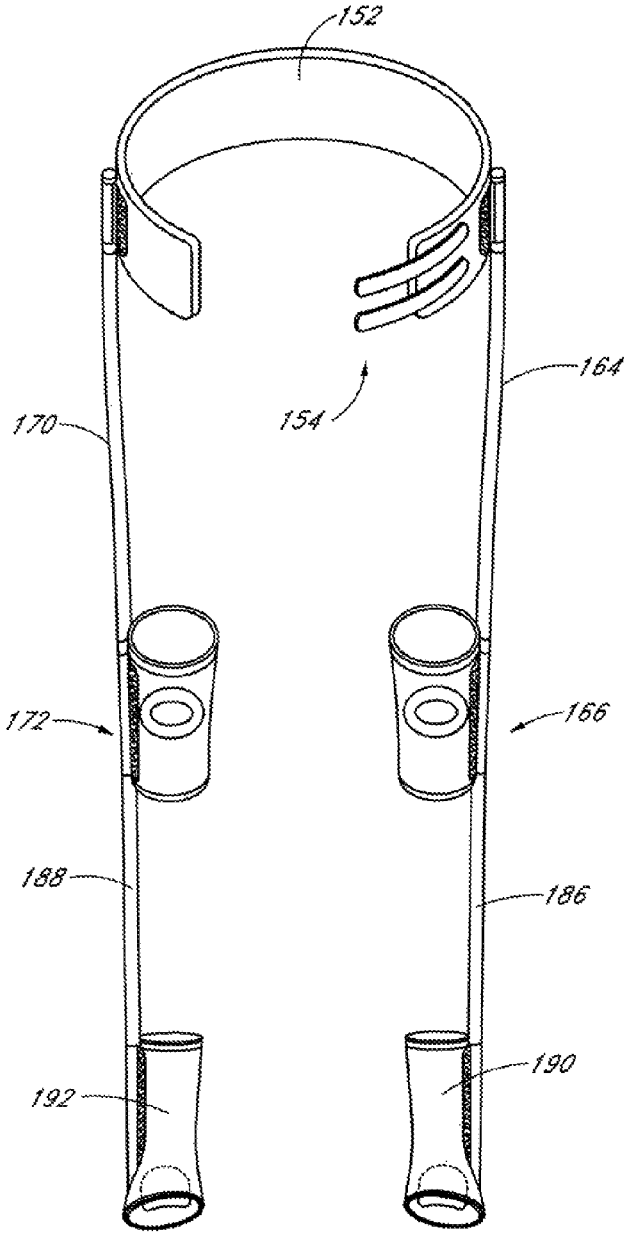
FIG. 5 is a front perspective view of an exercise device, for providing resistance to movement at both the hip and the knee.

Referring to FIG. 5, there is disclosed a further implementation of the present invention, which provides resistance to movement at both the hip as well as the knee. The embodiment of FIG. 5 is similar to that illustrated in FIG. 4, with the addition of a third resistance element 186 and a fourth resistance element 188 extending from the knee to the foot, ankle or leg below the knee. In the illustrated embodiment, the third resistance element 186 extends inferiorly to a foot or ankle support 190. The fourth resistance element 188 extends inferiorly to a second foot or ankle support 192. The foot or ankle supports 190 and 192 may comprise any of a variety of structures, such as an ankle band for surrounding the ankle, a boot or sock for wearing on the foot, and/or a shoe or other article to be attached in the vicinity of the foot.

Figure 6:
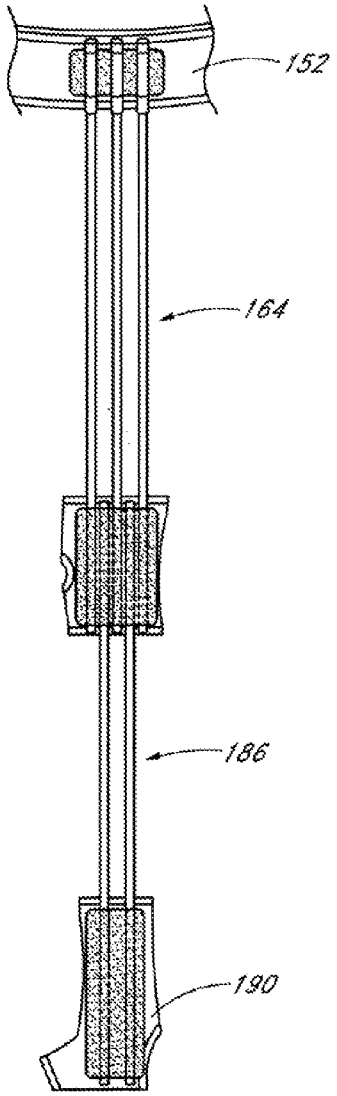
FIG. 6 is a side elevational view of the exercise device of FIG. 5, in which a greater degree of resistance is provided to movement at the hip compared to the knee.

Referring to FIG. 6, there is illustrated a side elevational view of an implementation of the design illustrated in FIG. 5. In this implementation of the invention, a first, second and third resistance elements are provided between the waistband and the knee, to provide a first level of resistance to movement. A first and second resistance elements are provided between the knee and the ankle, to provide a second, lower level of resistance between the femur and the ankle. Thus, different muscle groups may be challenged by different level of resistance as has been discussed previously herein.

Figure 8:
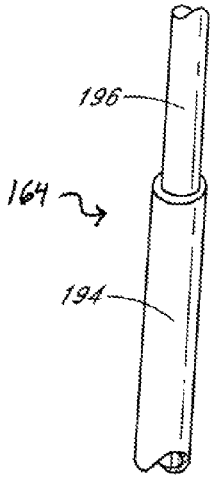
FIG. 8 is a partial elevational view of a resistance element in accordance with the present invention.
Figure 9A:
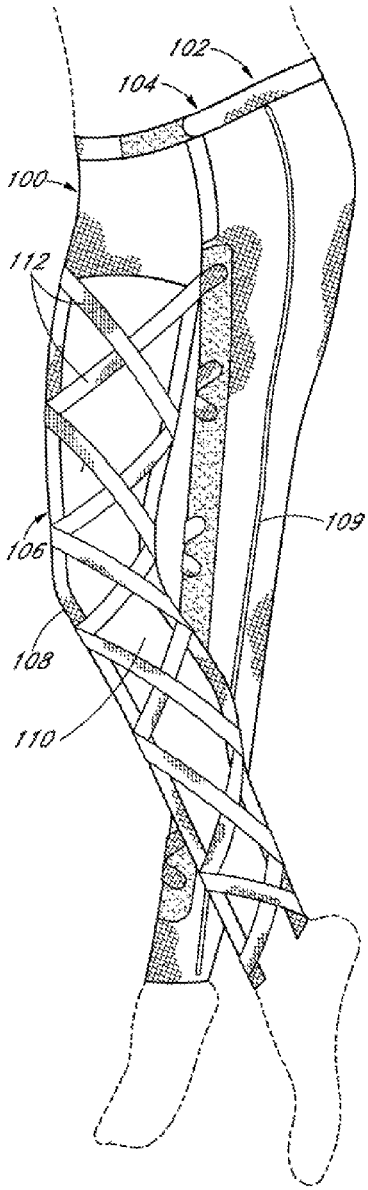
FIGS. 9A and 9B are perspective views of an alternative resistance garment in accordance with the present invention.
Figure 9B:
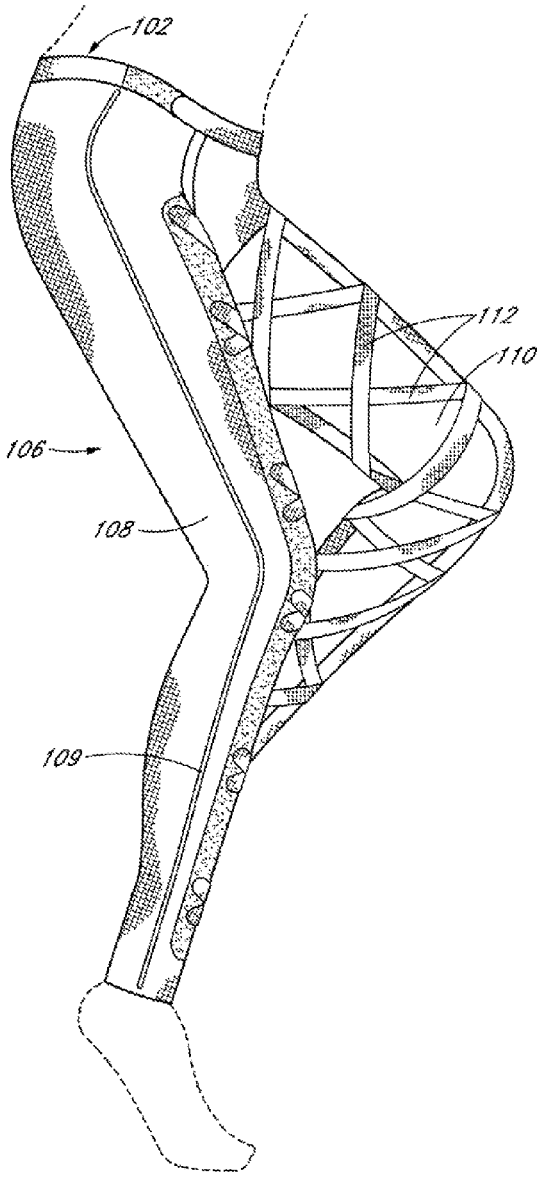
Figure 10:
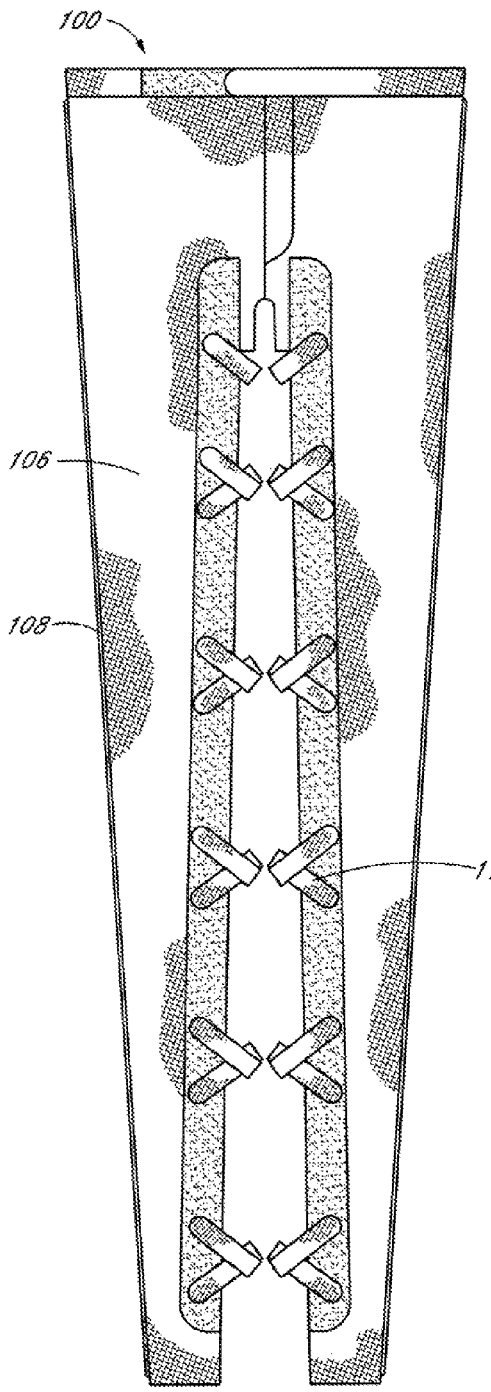
FIG. 10 is a front schematic view of a garment such as that in FIG. 9.
Figure 11:
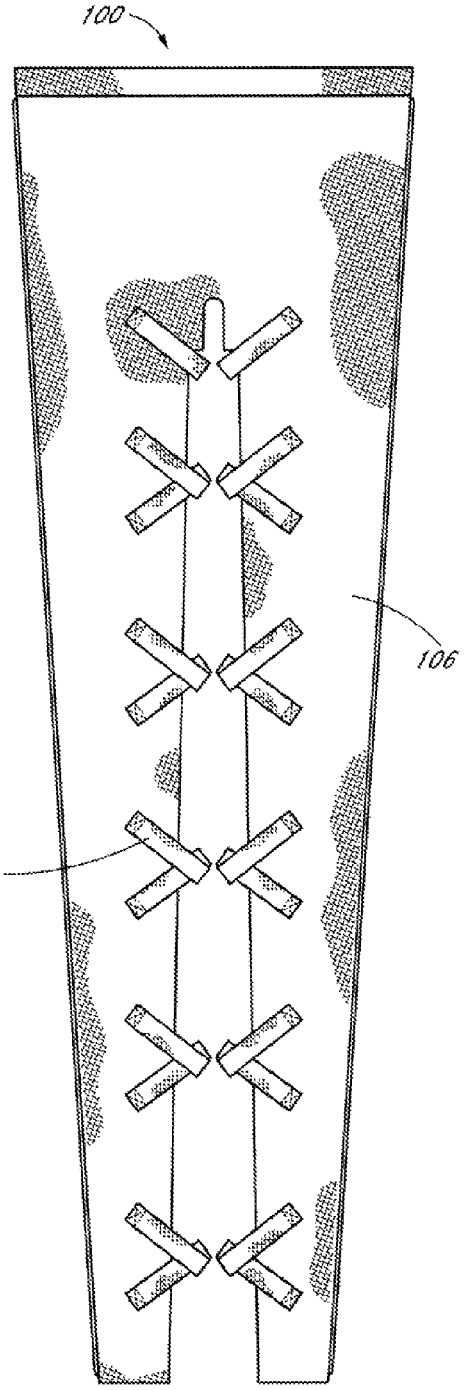
FIG. 11 is a rear schematic view of a garment such as that in FIG. 9.

A partially exploded view of a segment of a resistance element 164 is illustrated in FIG. 8. In one implementation of the invention, the attachment structure for attaching a resistance element to the body may be one or more belts, cuffs or garments as has been described herein. The attachment structure is provided with at least one sleeve 194 extending on a generally superior inferior axis on each side of the body and optionally on the medial side (inseam) of each leg. Sleeve 194 comprises any of a variety of flexible materials, such as fabric or polymeric tubing.

Sleeve 194 removably receives a resistance core 196. Core 196 may comprise one or more solid copper rods, segmented resistance element (discussed below) or other element which resist bending. A plurality of sleeves 194 may be provided on a garment or other attachment structure, such as two or three or four or five or more, extending in parallel to each other across a joint or other motion segment to provide a multi-component resistance element. The wearer may elect to introduce a resistance core 196 into each of the sleeves 194 (e.g. for maximum resistance) or only into some of the sleeves 194 leaving other sleeves empty. In this manner, the wearer can customize the level of resistance as desired.

Passive resistance or biased resistance to movement in accordance with the present invention may be built into a partial or full body suit, depending upon the desired performance characteristics. Resistance may be built into the body suit in any of a variety of ways, such as by incorporation of any of the foregoing structures (wires or other malleable materials) into the body suit, and/or incorporation of elastic stretch or flex panels of different fabrics as will be disclosed below.

Figure 7:
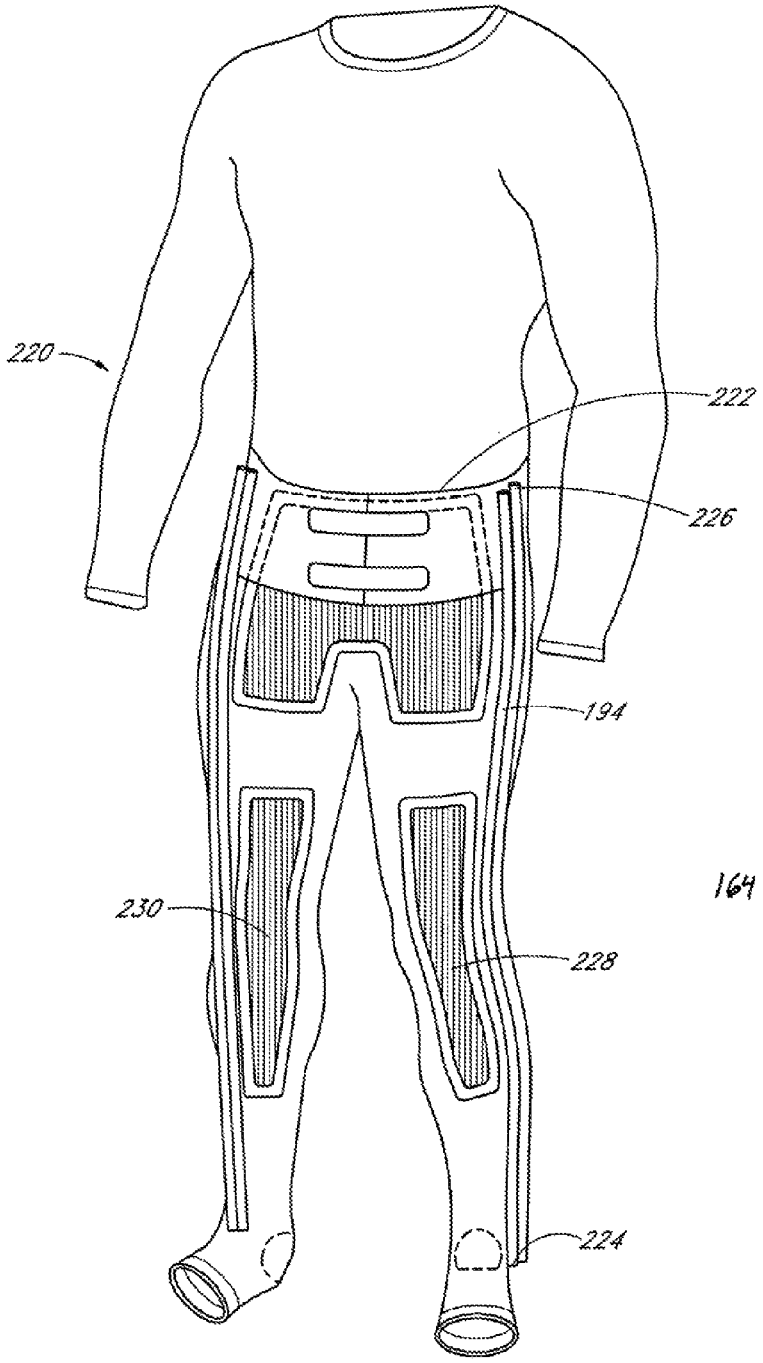
FIG. 7 is a front elevational view of a garment incorporating resistance features in accordance with the present invention.

Referring to FIG. 7, there is illustrated a front elevational view of a garment in the form of a full body suit 220, incorporating resistance elements in accordance with the present invention. Although illustrated as a full body suit, the garment may be in the form of pants alone, from the waist down, or an upper body garment similar to a shirt. In general, the body suit is provided with one or more resistance elements spanning a joint of interest, as has been discussed herein. The resistance element may be any of the devices disclosed previously herein, either removably or permanently attached to the fabric of the garment. For example, in the illustrated embodiment, a plurality of sleeves 194 extend proximally from the waist 222 down to the ankle 224 for permanently or removably receiving corresponding resistance elements therein. Preferably, the resistance elements may be removably carried by the garment, such as via an opening 226 illustrated at the superior end of sleeve 194, thereby enabling customization of the resistance level by the wearer. In addition, the resistance elements may preferably be removed for laundering the garment, and for taking the garment on and off. The garment can more easily be positioned on the body without the resistance elements, and the resistance elements may be introduced into the sleeve 194 or other receiving structure thereafter.

In addition, or as an alternative to the resistance elements disclosed previously herein, the garment may be provided with one or more elastic panels positioned and oriented to resist movement in a preselected direction. For example, an elastic panel having an axis of elongation in the inferior superior direction, and positioned behind the knee, can provide resistance to extension of the knee. Alternatively, a stretch panel on the front or anterior surface of the leg, spanning the knee, can bias the knee in the direction of extension and resist flexion. Panels 228 and 230 illustrated in FIG. 7 can be configured to stretch upon flexion of the knee thereby biasing the garment in the direction of extension. Resistance to flexion or extension or other movement of any other joint or motion segment in the body can be provided, by orienting one or more stretch panels of fabric in a similar fashion. In a passive resistance garment, the panels may comprise a plurality of wires or strands attached to or woven or braided into the fabric, as discussed below.

Any of a variety of fabrics may be utilized to form the garment, preferably materials which are highly breathable thereby allowing heat and moisture to escape, and having sufficient structural integrity to transfer force between the body and the resistance elements. The fabric can be compression or other elastic fabric, or an inelastic material with elastic panels in position to load specific muscle groups, or metal or metal-nonmetal hybrids depending upon the desired performance.

The woven resistance fabric of the present invention may comprise any of a variety of weaves typically between at least a first support filament and at least a second resistance filament. For example, the resistance fabric may comprise weaves such as plain weaves, basket weaves, rep or rib weaves, twill weaves (e.g., straight twill, reverse twill, herringbone twill), satin weaves, and double weaves (e.g., double-width, tubular double weave, reversed double weave). In general, the weave is a convenient structure for supporting a plurality of resistance imparting strands in a manner that can be made into or supported by a garment like structure that can be carried by a wearer's body. Nonwoven constructs can also be utilized, such as by securing a plurality of nonwoven (e.g., parallel) resistance strands (e.g., metal wire strands) to each other or to a supporting fabric base. Securing may be accomplished by dip coating, spray coating or otherwise coating or embedding the resistance strands with a flexible adhesive or other polymer, or weaving or braiding, to produce a flexible resistance band or sheet.

The term "strand" as used herein is a generic term for an elongate, thin flexible element suitable for weaving. For example, strands may include, but are not limited to monofilaments, filaments twisted together, fibers spun together or otherwise joined, yarns, roving yarns, crepe yarns, ply yarns, cord yarns, threads, strings, filaments laid together without twist, single strand or multi strand wire as well as other configurations. Strand includes elements sometimes referred to herein as rods, such that for example a 0.125 inch diameter copper rod is a relatively thick strand. Strand diameters will generally be at least about 0.018 inches, at least about 0.025 inches, at least about 0.040 inches, at least about 0.050 inches or at least about 0.10 inches or more, depending upon the construction and desired performance. For strands that are not circular in cross sections, the foregoing values can readily be converted to cross sectional areas as is understood in the art. Unless otherwise specified, references herein to strand diameters or cross sectional areas along the length of a strand or of a group of strands refers to an average value for the corresponding diameters or cross sectional areas.

A woven resistance fabric embodiment generally comprise at least a first and second sets of relatively straight strands, the warp and the weft, which cross and interweave to form a fabric. Typically, the warp and weft yarn cross at approximately a right angle as woven, but may cross at any angle such as at least about 45, 65, 75 or 85 degrees. Also typically, fabric is woven to have a given width, but may have any desired length. The warp yarn runs in the length direction of the fabric, which is generally the longer dimension thereof; and the weft yarn runs in the crosswise or width direction thereof, which is generally the shorter dimension. It may be convenient to weave passive resistance fabric such that the warp strand is a metal such as copper and the weft is a conventional athletic fabric material. The pants or body suit or resistance strips would be cut with the long axis of the resistance strands primarily running in an inferior-superior direction in the example of a pant, and the non-resistance strands run in a circumferential direction relative to the leg. A textile and/or fabric may be woven in a single-layer weave and/or in a plural-layer weave. It is noted that textiles and/or fabrics having two or more layers, i.e. plural layers, are commonly and generally referred to as multilayer weaves. Certain weaves may be referred to specifically, e.g., a two-layer woven fabric may be referred to as a double weave. For example, an inner liner may be provided for comfort, to separate the wearer from the resistance layer.

In one embodiment of the present invention, a first warp or weft fibers may be aesthetic fibers that are selected for their aesthetic appeal (e.g., color, texture, ability to receive dye, drapeability, etc.). Examples of such fibers may include natural fibers, cotton, wool, rayon, polyamid fibers, modeacrylic fibers, high modulus fibers, Kevlar® fibers, Nomex® fibers, and other fibers formulated to produce or exhibit aesthetic characteristics.

A second warp or weft fibers may be performance fibers that are selected for their strength or protective properties (e.g., cut, abrasion, ballistic, and/or fire resistance characteristics, etc.). Examples of performance fibers include high molecular weight polyethylene, aramid, carbon fiber, Kevlar® fibers, Nomex® fibers, fiberglass, and other fibers formulated to produce or exhibit performance characteristics. Many performance fibers are not aesthetically desirable (e.g., don't receive dyes or colors well, etc.); however, by structuring a fabric in accordance with various embodiments of the present invention, traditional aesthetic problems associated with such fibers may have a significantly reduced effect given that such fibers are generally hidden from view.

A third warp or weft fibers may be comfort fibers that are selected for their comfort-providing qualities (e.g., softness against a wearer's skin, cooling properties, etc.). Examples of comfort fibers include cellulosic fibers such as cotton, rayon, wool, microfiber polyester, nylon, and other fibers formulated to produce or exhibit comfort characteristics. In addition, the fibers that will extend around the leg and transverse to the metal fibers may be stretchable fibers that are selected to provide flexibility to the fabric to allow the fabric to have a better fit on the wearer and to allow the wearer more unrestricted movement while wearing the fabric. Examples of stretchable fibers include Lycra® fibers, Spandex® fibers, composite fibers that include Lycra® or Spandex® fibers, Kevlar® fibers, high modulus polyethylene, wool, rayon, nylon, modeacrylic fibers, and other fibers formulated to exhibit stretch characteristics.

Materials used for the shape memory element strands need only be biocompatible or able to be made biocompatible. Suitable materials for the shape memory element strands include shape memory metals and shape memory polymers. Suitable shape memory metals include, for example, TiNi (Nitinol), CuZnAl, and FeNiAl alloys. Particularly preferred are "superelastic" metal alloys. Superelasticity refers to a shape memory metal alloy's ability to spring back to its austenitic form from a stress-induced martensite at temperatures above austenite finish temperature. The austenite finish temperature refers to the temperature at which the transformation of a shape memory metal from the martensitic phase to the austenitic phase completes.

For example, martensite in a Nitinol alloy may be stress induced if stress is applied at a temperature above the Nitinol alloy's austenite start temperature. Since austenite is the stable phase at temperatures above austenite finish temperature under no-load conditions, the material springs back to its original shape when the stress is removed. This extraordinary elasticity is called superelasticity. In one example, Nitinol wire may be in the superelastic condition where the wire has been cold worked at least 40% and given an aging heat treatment at approximately 500 degrees Celsius for at least 10 minutes. The Nitinol wire is in its fully superelastic condition where the use temperature is greater than the austenite finish temperature of the Nitinol wire.

The term "elastic" is used to describe any component that is capable of substantial elastic deformation, which results in a bias to return to its non-deformed or neutral state. It should be understood that the term "elastic" includes but is not intended to be limited to a particular class of elastic materials. In some cases, one or more elastic portions can be made of an elastomeric material including, but not limited to: natural rubber, synthetic polyisoprene, butyl rubber, halogenated butyl rubbers, polybutadiene, styrene-butadiene rubber, nitrile rubber, hydrogenated nitrile rubbers, chloroprene rubber (such as polychloroprene, neoprene and bayprene), ethylene propylene rubber (EPM), ethylene propylene diene rubber (EPDM), epichlorohydrin rubber (ECO), polyacrylic rubber, silicone rubber, fluorosilicone rubber (FVMQ), fluoroelastomers (such as Viton, Tecnoflon, Fluorel, Atlas and Dai-EI), perfluoroelastomers (such as Tecnoflon PFR, Kalrez, Chemraz, Perlast), polyether block amides (PEBA), chlorosulfonated polyethylene (CSM), ethylene-vinyl acetate (EVA), various types of thermoplastic elastomers (TPE), for example Elastron, as well as any other type of material with substantial elastic properties. In other cases, an elastic portion could be made of another type of material that is capable of elastic deformation or composite weaves of elastic and inelastic fibers or threads. In one exemplary embodiment, each elastic portion may include neoprene potentially augmented by a secondary elastic component such as sheets or strips of a latex or other rubber depending upon the desired elastic force and dynamic range of stretch.

Another fabric with a high modulus of elasticity is elastane, which is known in the art of compression fabrics. The material may be a polyester/elastane fabric with moisture-wicking properties. For example, the fabric may comprise 5 oz/yd-.sup.2 micro-denier polyester/elastane warp knit tricot fabric that will wick moisture from the body and include 76% 40 denier dull polyester and 24% 55 denier spandex knit. The high elastane content allows for proper stretch and support. The fabric may be a tricot construction at a 60" width. The mean warp stretch may be 187% at 10 lbs of load, and the mean width stretch may be 90% at 10 lbs of load. This fabric also may have a wicking finish applied to it. Such a fabric is available from UNDER ARMOUR™ Although the foregoing fabric is given as an example, it will be appreciated that any of a variety of other fabric or other materials known in the art may be used to construct the garment 100, including compression fabrics and non-compression fabrics. Examples of such fabrics include, but are not limited to, knit, woven and non-woven fabrics comprised of nylon, polyester, cotton, elastane, any of the materials identified above and blends thereof. Any of the foregoing can be augmented with mechanical resistance elements, such as bendable rods, springs and others disclosed herein.

The fabric can be characterized by the total cross sectional area of metal per unit length of fabric, measured transverse to the direction of the metal strands. For example, a plain weave having parallel metal strands each having a diameter of 0.020 inches, each adjacent strands separated by 0.020 inches, will have a metal density of 25 strands per inch. The sum of the cross sections of the 25 strands is approximately 0.008 square inches.

The optimal metal density will depend upon garment design, such as whether the entire circumference of a leg is surrounded by hybrid fabric, or only discrete panels will include the hybrid fiber, the presence of any supplemental resistance elements, and the desired resistance provided by a given motion segment on the garment. In general, the metal density will be at least about 0.010 square inches of metal per running inch of fabric, and may be at least about 0.020, at least about 0.030 and in some implementations at least about 0.040 square inches of metal per inch. Most fabrics will have within the range of from about 0.020 and about 0.060 square inches of metal per inch of fabric, and often within the range of from about 0.025 and about 0.045 square inches per inch of fabric.

Referring to FIGS. 9A, 9B, 10 and 11, there is illustrated a side opening pant embodiment of the present invention which can support either resistance fabric, resistance rods or both types of resistance element. The pant 100 comprises a waist 102 which may be opened or closed or tightened by a fastener 104. Fastener 104 may be any of a variety of preferably low profile and comfortable adjustable fasteners such as Velcro or a belt buckle.

A right leg 106 comprises a resistance panel 108 and a side opening 110. The resistance panel runs from the waist to the ankle and may be made from or support a resistance fabric and or resistance strands. The resistance panel may have an average width measured in the circumferential direction around the leg of no more than about 2", sometimes no more than about 4" and often no more than about 6" or 8" so that it does not wrap all the way around the leg. Typically, the resistance panel will be oriented to run along the lateral side of the leg, although additional resistance panels may run along the medial side, the posterior or anterior or any one or combination of the foregoing, depending upon the desired performance.

The resistance panel may be constructed from a resistance fabric, or may have one or more panels of resistance fabric carried thereon. The resistance panels may also or alternatively be provided with at least one or two or three or four or more attachment structures or guides such as sleeve 109, for receiving a resistance element such as a malleable rod or other resistance element disclosed elsewhere herein. The sleeve may have a closed inferior end and an open or openable superior end, to removably receive the resistance element therein, so that the wearer can customize the resistance level as desired.

In the illustrated embodiment, the right resistance panel 108 is securely held against the leg by a plurality of straps 112 which extend across the opening 110. Each strap has a first end which is preferably permanently secured to the resistance panel 108, and a second end which may be releasably secured to the resistance panel such as by Velcro or other releasable fastener. The left and right legs are preferably bilaterally symmetrical.

The straps 112 preferably comprise a stretch fabric such as a weave with elastic fibers at least running in the longitudinal direction. One or two or three or more straps 112 may be provided both above and below the knee, to securely hold the resistance panel in place. Straps 112 may be oriented perpendicular to the long axis of the leg, or an angle as illustrated to provide a criss cross configuration.

Figure 12:
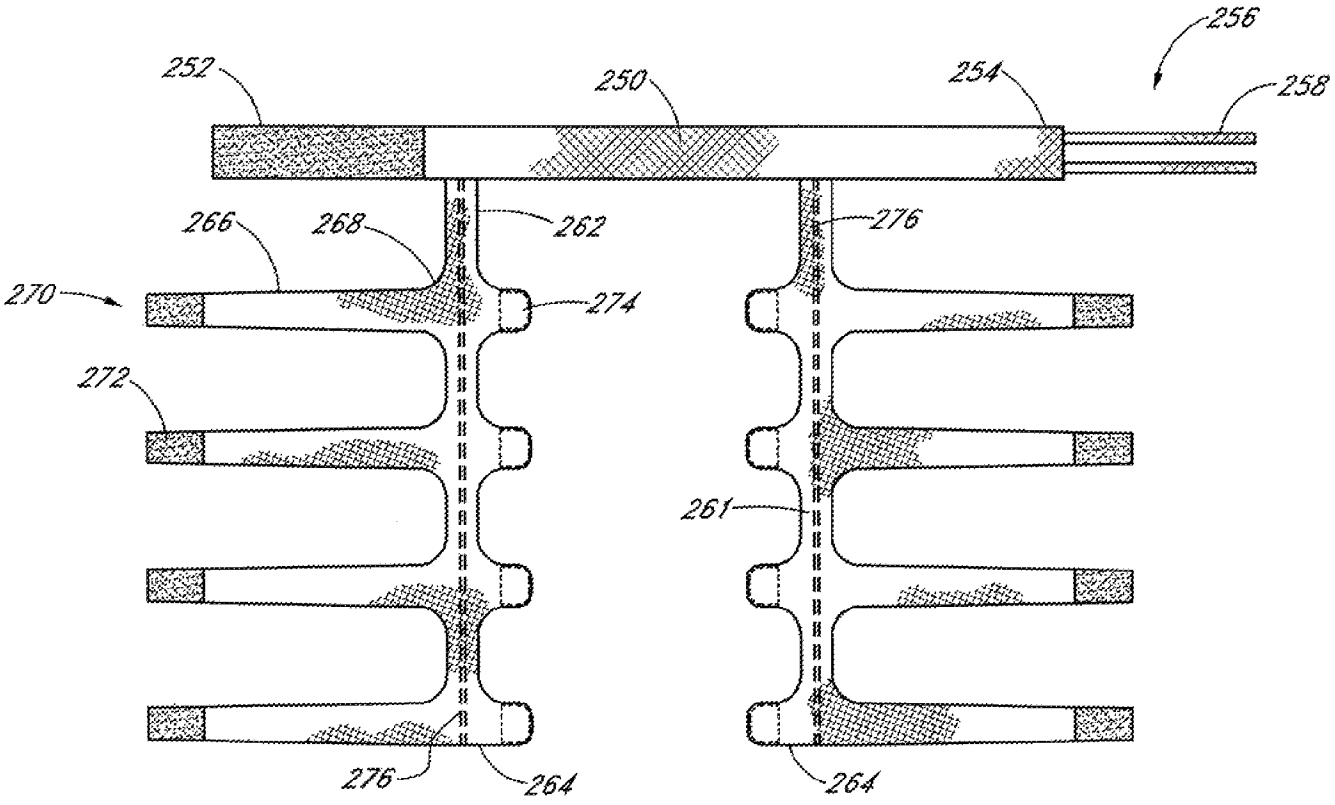
FIG. 12 is a flat plan view of an alternative resistance garment in accordance with the present invention.

Referring to FIG. 12, there is illustrated a flat pattern for a modified implementation of the invention. Waistband 250 extends between a left end 252 and a right end 254. A fastener 256 such as one or two or more Velcro straps 258 may be provided on either end of the waistband 250.

A left resistance panel 260 and right resistance panel 261 are attached to or formed integrally with the waistband and configured for attachment to the wearer's left and right legs, respectively. Attachment may be removable, such as by zippers as is discussed elsewhere herein. Left resistance panel 260 extends between a superior end 262 attached to the waistband 250 and an inferior end 264 which may be attached to the wearer below the knee such as in the vicinity of the ankle or to a shoe. A plurality of straps 266 are attached at one end 268 to the resistance panel 260 and a second free end 270 is configured so that the strap 266 can be wrapped around the wearer's leg and the free end 270 can be attached to the resistance panel 260 at an attachment zone 274 such as with Velcro or other fastener. In one implementation the free end 270 is fed through a buckle and looped back and attached to the strap 266, so that the strap can be easily tensioned as desired before fastening the fastener. At least about 4 or 6 or 8 or more straps may be provided for each leg, depending upon the materials used and the intended level of resistance that the garment will impose.

Each resistance panel can be made from a resistance fabric, or carry resistance fabric or other resistance element thereon. Alternatively, each resistance panel can be provided with attachment structures such as one or two or more connectors or sleeves for receiving resistance elements. In the illustrated embodiment, a first sleeve 276 spans both the hip and knee, and a second, shorter sleeve (not illustrated) spans the hip, for receiving copper rods or other resistance element. As discussed previously, the garment will generally impose a greater resistance across the hip than across the knee.

The resistance panel 260 may comprise both resistance fabric, as well as an attachment structure such as a sleeve for receiving a resistance element such as a solid or segmented rod or for the attachment of additional resistance panels. This enables wearer customization of the resistance level and profile of the garment.

Figure 13:
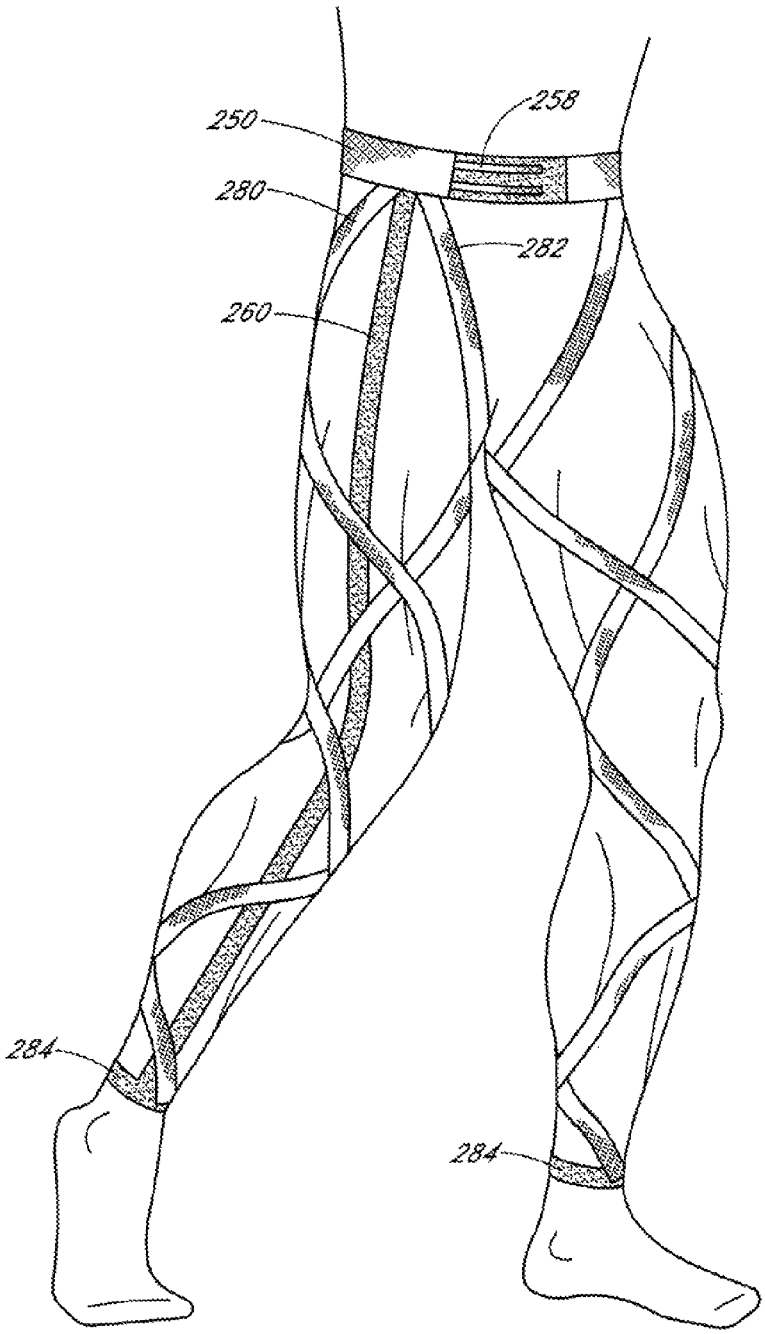
FIG. 13 is a perspective view of an alternative resistance garment in accordance with the present invention.
Figure 14:
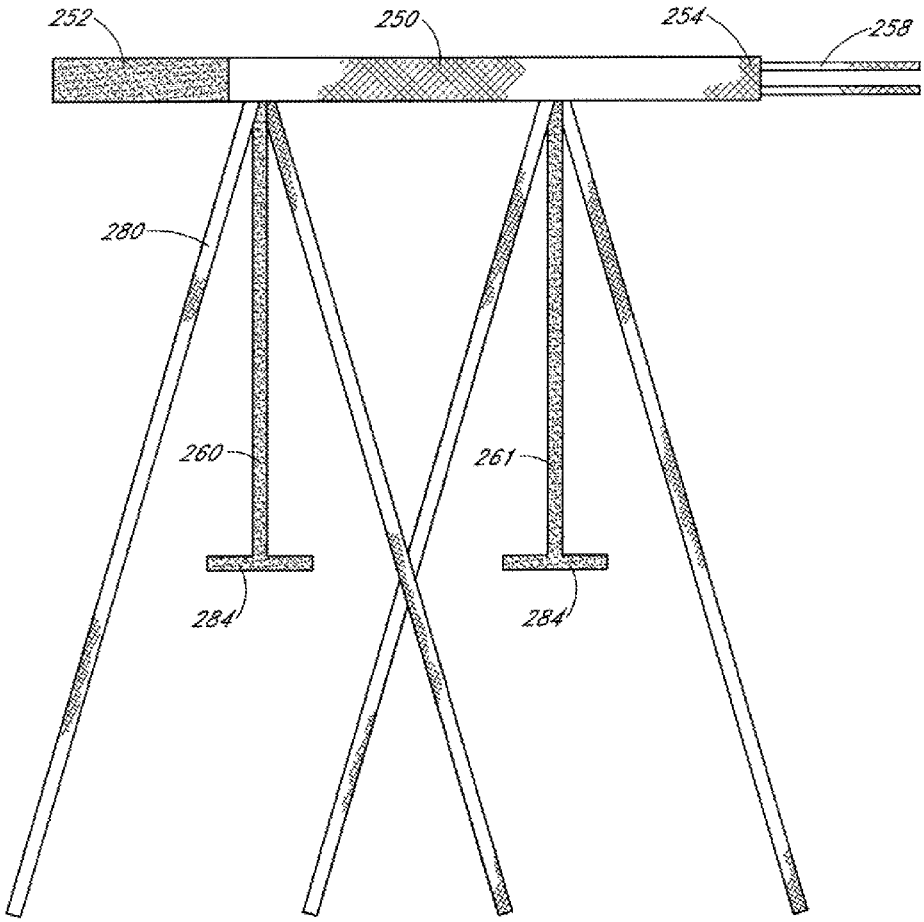
FIG. 14 is a flat plan view of the resistance garment of FIG. 13.

Referring to FIGS. 13 and 14, a resistance garment is shown having a waist or belt 250 and left and right resistance panels 260 and 261. In this implementation, the resistance panels may have an average width of no more than about 8 inches, no more than about 6 inches, no more than about 4 inches, no more than about 2 inches, or no more than about 1 inch depending upon whether resistance is generated by a fabric or other resistance element.

The left resistance panel is associated with at least a first strap 280 and as illustrated also a second strap 282 which are secured to the waist and or the resistance panel 260. As shown in FIG. 13, the first strap is wrapped helically around the leg and secured to the ankle by attachment to itself, or to the left resistance panel 260 or to an ankle strap 284 that may be provided at the inferior end of the resistance panel 260. The second strap 282 may then be wrapped helically around the leg in the opposite direction and secured to the ankle. At each of the crossing points between the straps 280 and 282 and the resistance panel 260 complementary Velcro panels align and create attachment points. Preferably the straps comprise stretch fabric to hold the resistance panel snugly in place yet accommodate moving musculature.

Figure 15:
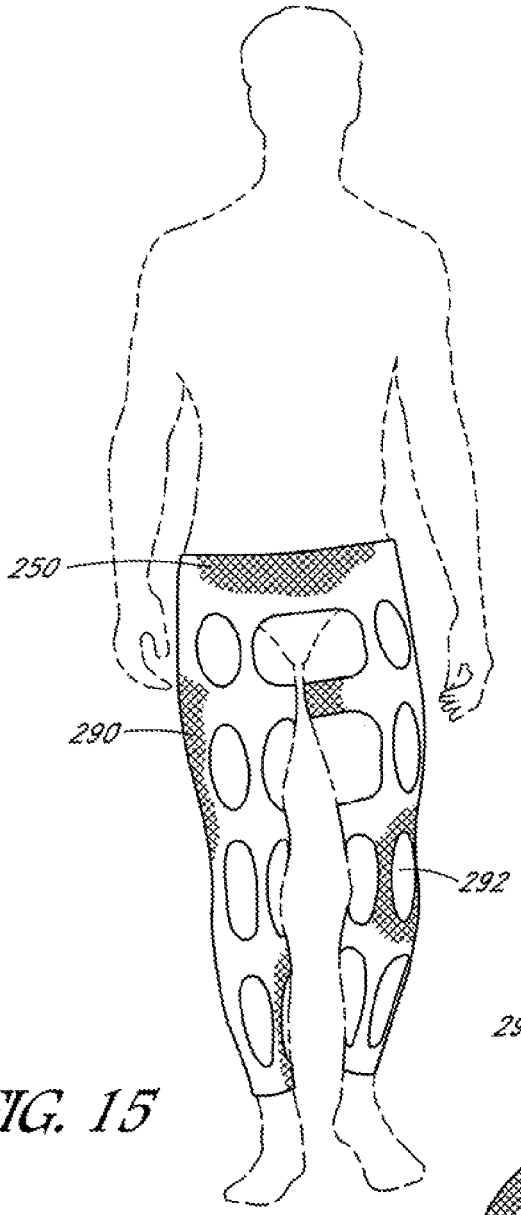
FIGS. 15 and 16 show an alternate implementation of the invention.
Figure 16:
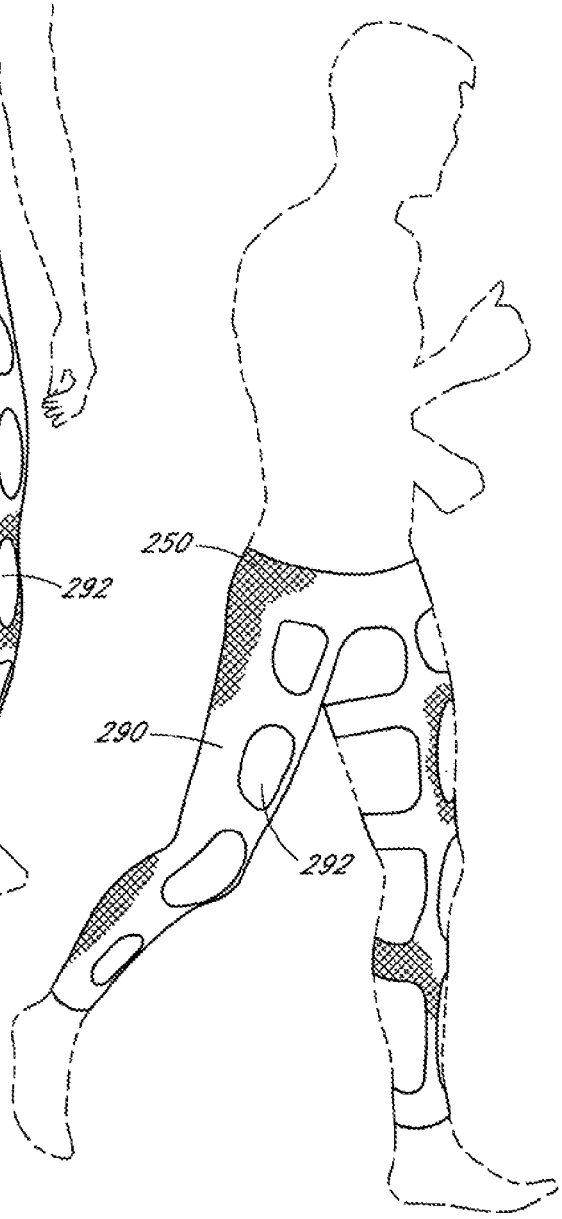

Another implementation is shown in FIGS. 15 and 16, in which a lateral resistance panel 290 is provided on each leg, as well as an anterior resistance panel 292. Anterior resistance panels may be provided with or without lateral or medial or posterior resistance panels depending upon the desired performance of the garment. While lateral or medial resistance panels will primarily bend in response to stride, anterior or posterior panels may both bend, as well as axially elongate and contract in response to stride.

Figure 17:
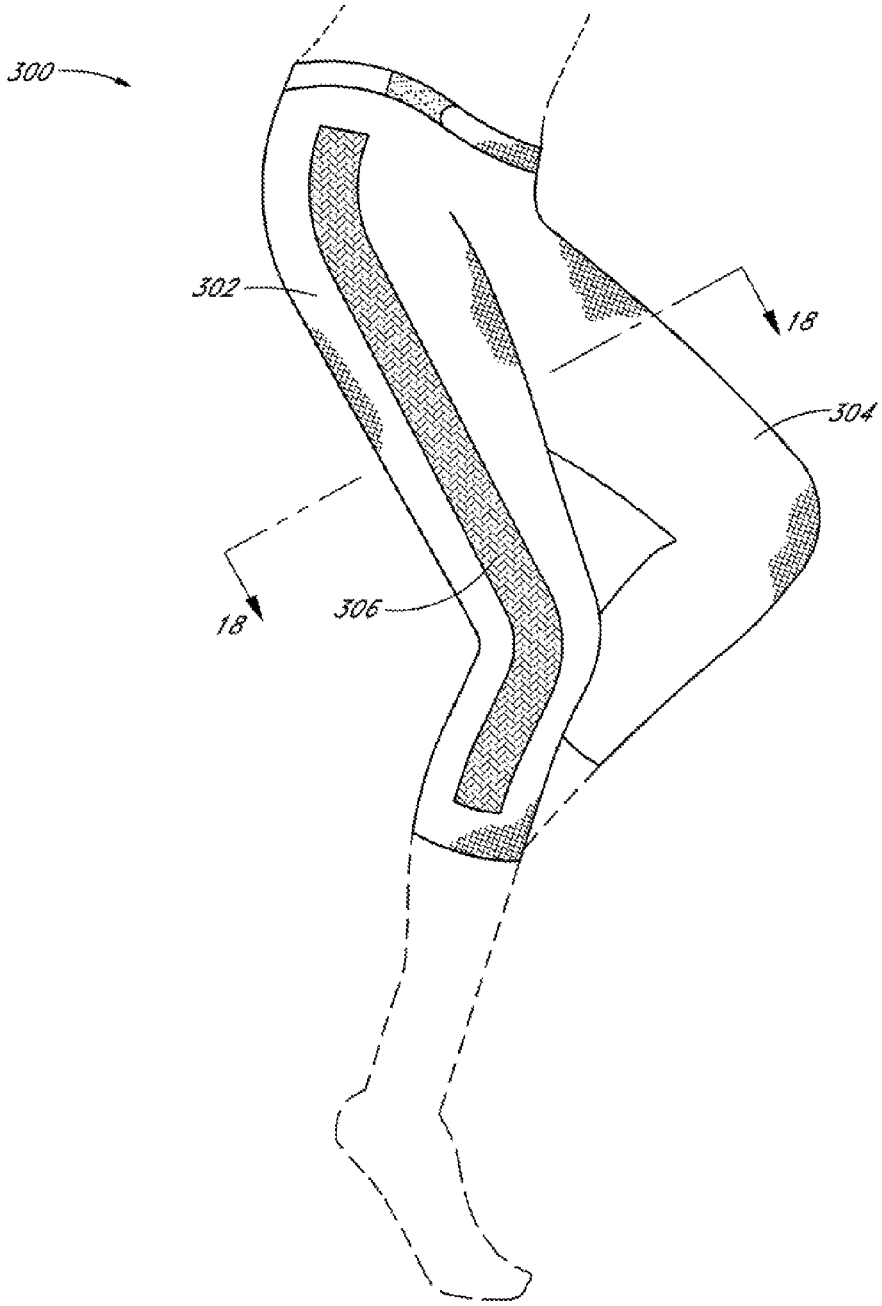
FIG. 17 is a side elevational view of a detachable component toning garment, having a resistance element extending in the inferior-superior direction.

Referring to FIG. 17, there is illustrated a toning garment 300 having a right leg 302 and a left leg 304. At least one resistance elements 306 is provided on each of the left leg 304 and right leg 302. In the illustrated embodiment, a single resistance element 306 is provided on each of the right and left legs, extending in an inferior-superior orientation on a lateral side of the leg, and spanning both the hip and knee. Resistance elements 306 may be provided on the lateral sides, the medial sides, or the lateral and medial sides of the leg. In this orientation, the bending of the resistance elements 306 is primarily in the anterior-posterior plane (in shear for a flat resistance element 306).

Alternatively, resistance elements 306 may be provided on the anterior or posterior or both aspects of the garment 300. Normal anatomical motion at the hip and knee would cause anterior or posterior resistance elements 306 to bend out of plane, and also to accommodate axial elongation and compression during the normal walking cycle. Thus, internal construction of anterior or posterior surface resistance elements 306 may be different than that utilized on a lateral or medial orientation.

Figure 18:
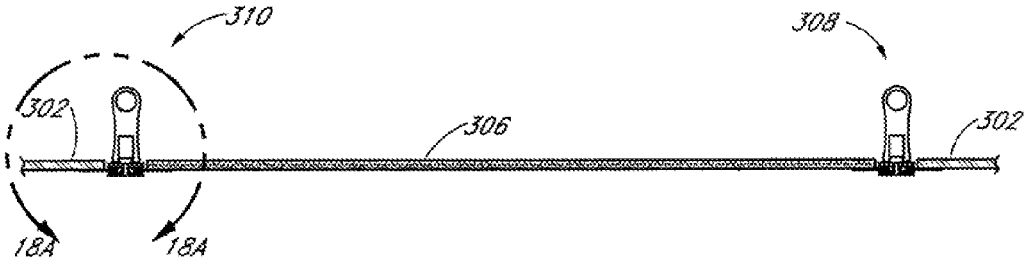
FIG. 18 is a cross-sectional view taken along the line 18-18 of FIG. 17, showing a removable resistance element secured to the garment.

Preferably, resistance elements 306 are removably secured to the garment 300. Referring to FIG. 18, removable attachment may be accomplished by providing a posterior attachment structure 308 secured to the right leg 302 and an anterior attachment structure 310 secured at an anterior orientation on the right leg 302. As with elsewhere herein, the devices of the present invention are preferably bilaterally symmetrical and only one side will generally be described in detail with the understanding that the other side will have a symmetrical configuration.

Figure 18A:
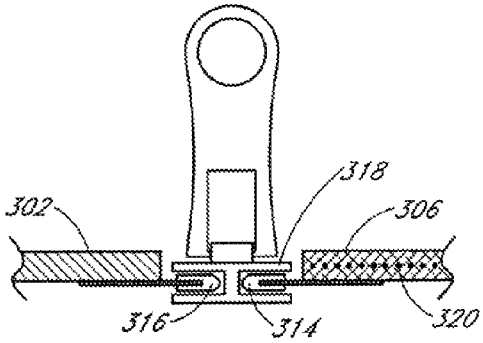
FIG. 18*a* is an enlarged view taken along the line 18*a*-18*a* of FIG. 18.

Each of the posterior attachment structure 308 and anterior attachment structure 310 are preferably attachment structures that permit secure attachment and removal of the resistance elements 306 to the garment 300. Referring to FIG. 18A, one exemplary attachment structure 308 is a zipper. A first plurality of teeth 314 may be secured along the length of the resistance elements 306 such as by stitching, adhesives, or other technique. First plurality of teeth 314 are configured to interdigitate or engage with a second plurality of teeth 316 secured along an edge which is attached to the toning garment 300. A slider 318 may be advanced up and down the inferior posterior direction, zipping and unzipping the resistance element 306 to the right leg 302.

Schematically illustrated in the resistance element 306 of FIG. 18A is a plurality of malleable strands 320, such as may be present in a wire fabric weave. However, any of the resistance elements described in the present application may be configured for interchangeable replacement with the resistance elements 306. Thus, the user of the toning garment 300 may select a resistance element out of an array of resistance elements, and releasable secure the resistance elements 306 to the garment 300. After a period of time, the resistance elements 306 may be removed from the toning garment 300 and replaced by a resistance element 306 having a different resistance characteristic. Alternatively, the resistance elements 306 may be removed and replaced by a resistance element having an identical resistance characteristic, such as following the useful life of the first resistance element.

A plurality of interchangeable resistance elements having different structures can be provided, such as metal wire, metal weaves, segmented resistance elements, pivotable resistance elements, open cell or closed cell foam, elastomeric materials such as silicone, latex or various blends of rubber, resistance elements having pulleys and wires, can be configured having an interchangeable mounting system and dimensions so that they may be interchanged on a single toning garment 300.

Figure 19:
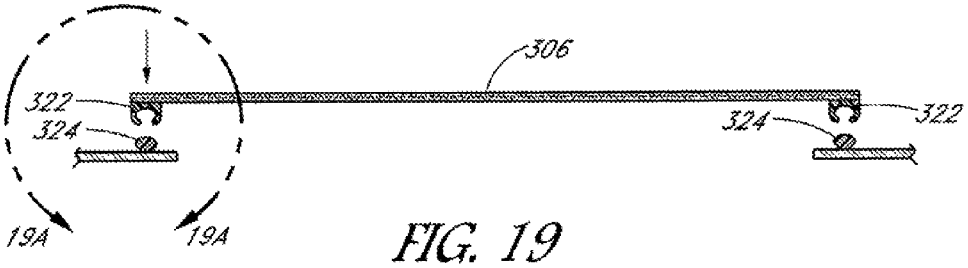
FIG. 19 is a cross-sectional view through a detachable component resistance element, showing an alternate attachment structure.
Figure 19A:
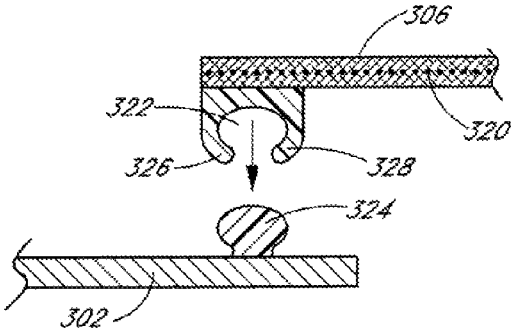
FIG. 19*a* is an enlarged view taken along the line 19*a*-19*a* in FIG. 19.

An alternative attachment structure comprises an elongate press fit attachment, that extends in the inferior superior axis, typically along the edges of the resistance elements 306. Referring to FIG. 19, one of the resistance elements 306 and corresponding locations on the garment 300 is provided with an elongate elastically deformable channel 322. The corresponding or complementary surface structure on the other of the resistance elements 306 or the garment 300 is an elongate bead 324. The elongate bead may be press fit into the elongate channel, like a zip lock fastener, to secure the resistance elements 306 in place. Press fitting the fastener to releasably retain the resistance elements 306 on the garment 300 may be accomplished by manual pressure, such as by running a finger along the length of the attachment structure.

Figure 20:
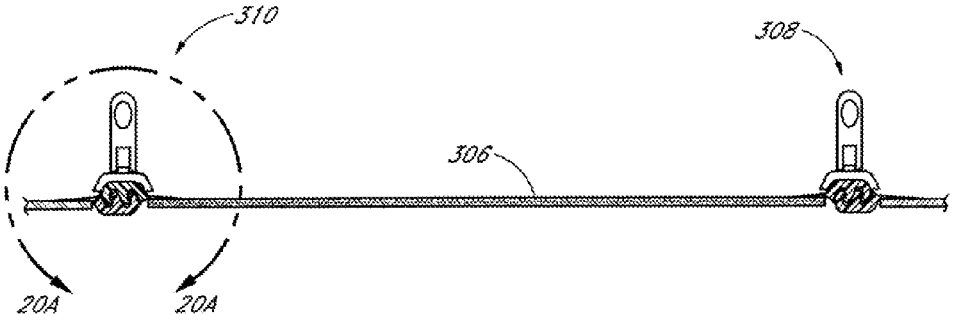
FIG. 20 is a cross-sectional view as in FIG. 18, showing an alternate attachment structure between the resistance element and the garment.
Figure 20A:
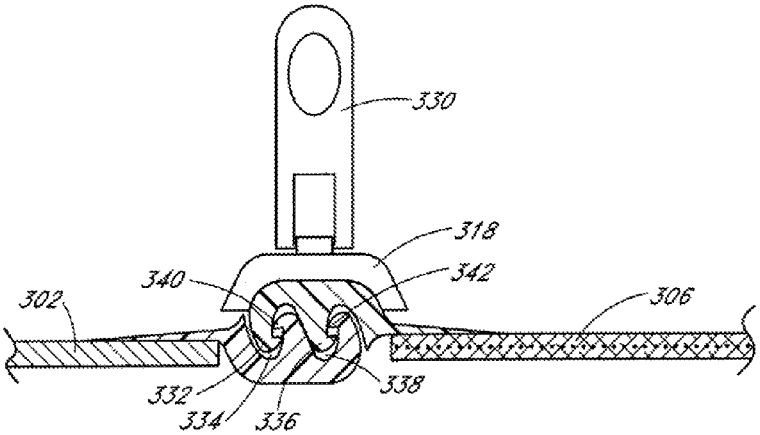
FIG. 20*a* is an enlarged view taken along the line 20*a*-20*a* in FIG. 20.

Alternatively, such as is illustrated in FIGS. 20 and 20A, a press fit embodiment may be secured and unsecured using a slider 318, typically having a pull tab 330. The implementation of the press fit fastener shown in FIGS. 20 and 20A provide a more robust connection between the resistance element 306 and garment 300. This may be desirable for implementations of the invention having relatively high resistance to movement, which will place greater tension on the attachment structure.

Referring to FIG. 20A, a first projection 332 attached directly or indirectly to the resistance element 306 or garment 300 it is removable received within a first recess 334 attached to the other of the resistance element 306 and garment 300. A second projection 336 is received within a second recess 338. A first pair of complementary engagement surfaces 340 is provided to create an interference fit within the first recess 334, and a second pair of complementary engagement surfaces 342 provide an interference fit within the second recess 338. This configuration can withstand a relatively high shear force such as might be experienced under tension, while at the same time enabling a relatively low release force such as by deformation of the pairs of complementary engagement surfaces as will be understood to those of skill in the art.

Figure 21:
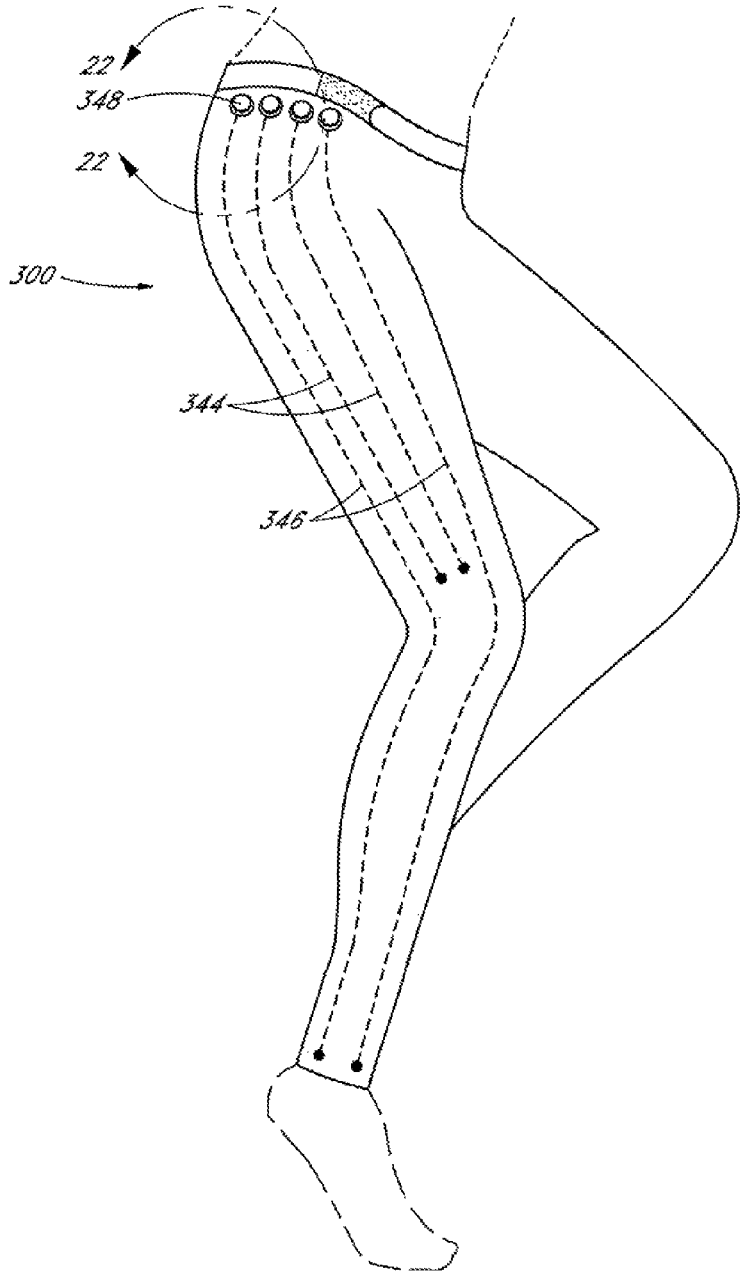
FIG. 21 is a side elevational view of an alternate toning garment in accordance with the present invention.

Referring to FIG. 21, there is illustrated a garment having a plurality of resistance elements, which happen in the illustrated embodiment to provide about twice as much resistance to rotation across the hip than the knee. This is accomplished by providing a first and second resistance elements 344 extending from about the waist to a point above the knee. A third and fourth resistance elements 346 extend from about the hip beyond the knee and preferably to approximately the ankle. The resistance elements may be any of a variety of structures disclosed elsewhere herein, including an adjustable or variable resistance element as will be discussed below.

The variable resistance element is convertible between a first disengaged configuration in which it is relatively freely flexible, and a second engaged configuration in which it provides a relatively higher resistance to bending. The disengaged configuration may enable a wearer to get into or out of the garment more easily with the resistance elements attached, or may enable the resistance element to be advanced through a sleeve or other retention structures on the garment with greater ease. Once a garment is properly positioned on the wearer, a control may be activated to convert the resistance element from the flexible, disengaged state to the engaged state, for use. In the embodiment illustrated in FIG. 21, a control 348 is illustrated for each of the resistance elements. However, a single control may be provided to simultaneously control at least 2 or 3 or all of the resistance elements, depending upon the desired performance.

The control 348 may be a knob, switch, lever, or any of a variety of structures depending upon the construction of the resistance element. In the illustrated embodiment, the control comprises a knob. The knob may be popped in or out along its axis of rotation to engage or disengage, and when engaged, may be rotated to tighten the resistance element.

Figure 22:
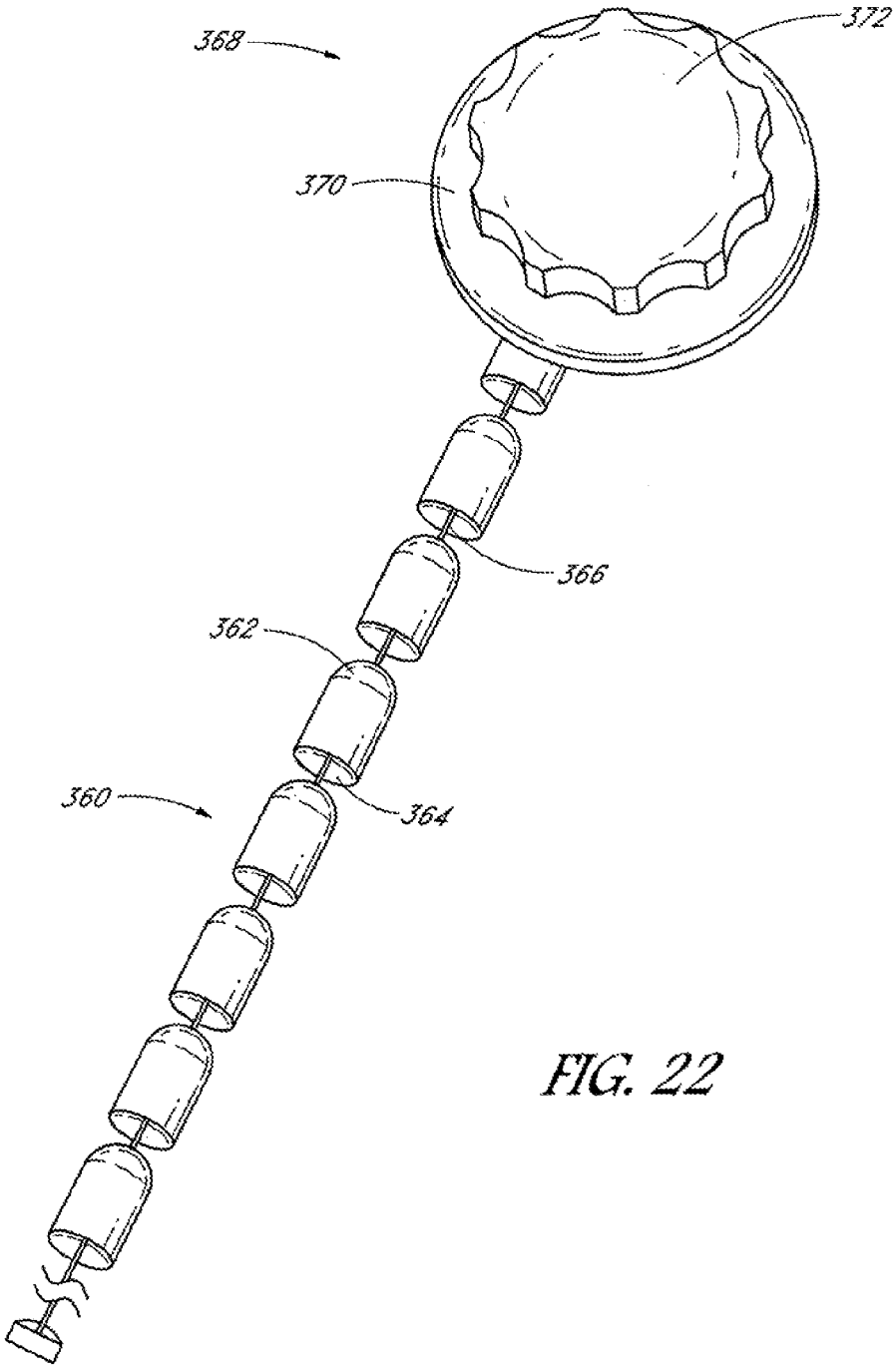
FIG. 22 is an exploded, perspective view of a segmented resistance element in accordance with the present invention.

Referring to FIG. 22, a segmented resistance element 306 is illustrated, of the type that may be utilized in FIG. 21. Resistance element 306 comprises a plurality of segments 360, each segment 360 having a proximal end 362 and a distal end 364. A central cannulation or lumen runs axially through each segment 360, to moveably receive a cable or pull wire 366. A plurality of at least about 5, generally at least about 10, and in some implementations at least about 20 or more segments 360 are carried by a single pull wire 366, and attached to a proximal control 368. Control 368 comprises a housing 370 having a winding mechanism (not shown) and a knob 372.

At least one of the proximal end 362 and distal end 364 of segment 360 is provided with a convex, preferably hemispherical or otherwise curved articulation surface. This articulation surface nests within a corresponding concavity on the adjacent segment 360, such that the two segments can angularly move with respect to each other while remaining nested.

In the illustrated embodiment in FIG. 22, the segments are shown in a relaxed or floppy state, with an excess of pull wire 366. Activation of the control such as by tightening the knob 372 pulls the pull wire 366 into the housing 370, applying axial compression to the various segments 360. Once under compression, the construct can only be bent laterally when the friction between adjacent nested surfaces is overcome. In this manner, tightening the knob 372 can provide resistance to bending over the resistance element.

The level of resistance to bending achieved by the embodiment illustrated in FIG. 22 can be modified in any of a variety of ways as will be understood in the art. For example, the level of polish or roughness of the articulating surfaces will directly affect the amount of force required to bend the resistance element once under tension. One or both of the convex and concave articulating surfaces may be provided with a texture, such as by etching or coating with a fine particulate material. Alternatively, certain materials inherently have differing levels of resistance. Segments 360 may be machined from metal, such as stainless steel, titanium, aluminum, or may be extruded or otherwise formed from a polymeric material. In some implementations of the invention, the segments 360 comprise nylon, polyethylene, PEEK, Teflon, or other materials known in the art.

Figure 23:
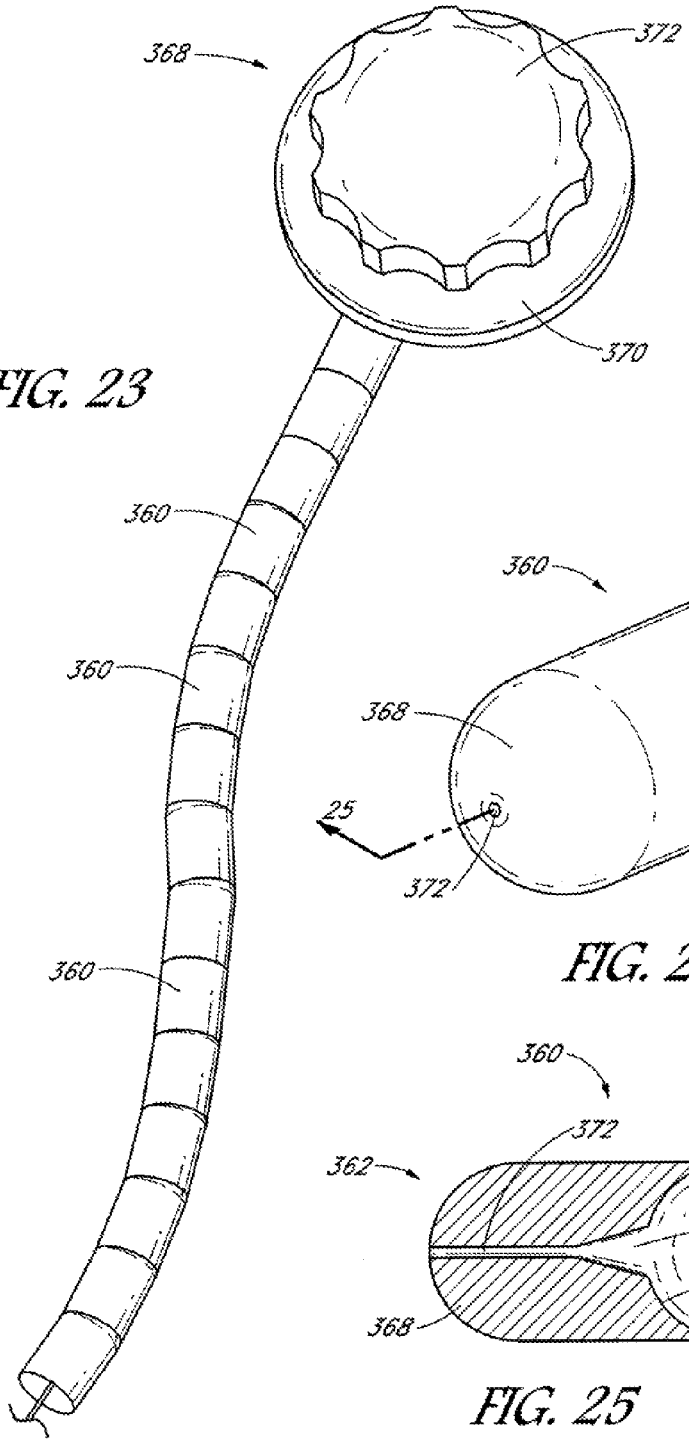
FIG. 23 is a perspective view of the resistance element of FIG. 22, shown with a plurality of segments under compression.

FIG. 23 shows the resistance element of FIG. 22, with the knob 372 rotated to lock the resistance element in the engaged configuration.

Figure 24:
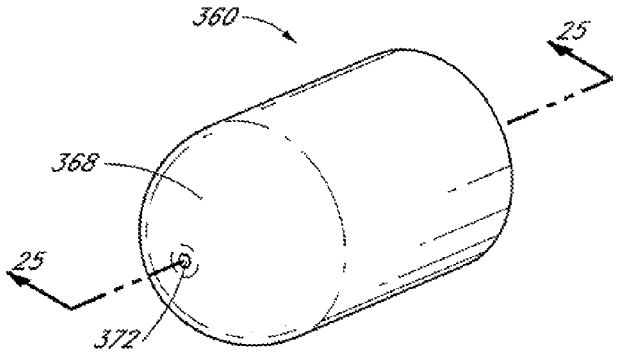
FIG. 24 is a perspective view of a single segment.
Figure 25:
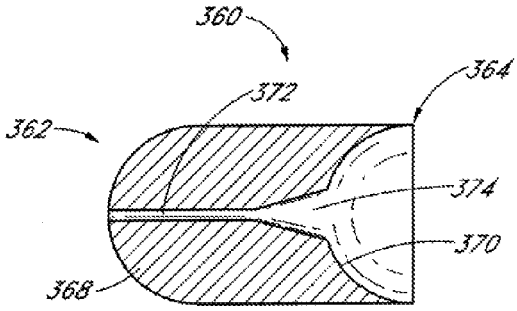
FIG. 25 is a cross-sectional view taken along the line 25-25 in FIG. 24.

Referring to FIGS. 24 and 25, an individual segment 360 comprises a proximal end 362 and distal end 364, although the orientation may be reversed. In the illustrated embodiment, proximal end 362 comprises a convex articulation surface 368 and a concave articulation 370. A central lumen 372 extends between the proximal end 362 and distal end 364, to moveably receive the pull wire 366 as previously discussed.

In order to accommodate sliding rotation of an adjacent pair of segments 360, the junction between the concave articulation surface 370 and lumen 372 is provided with a conical segment 374, to accommodate minor lateral movement of the pull wire 366 in response to bending of the resistance element. A conical flare may also be provided at the proximal end of the lumen 372.

Referring to FIGS. 26 through 29, there is illustrated an alternative segment 360. While the segments illustrated in FIGS. 22 through 25 enable deflection in 360°, the segments illustrated in FIGS. 26 through 29 are configured to substantially limit movement to within a single plane as will be appreciated by those of skill in the art.

Figure 28:
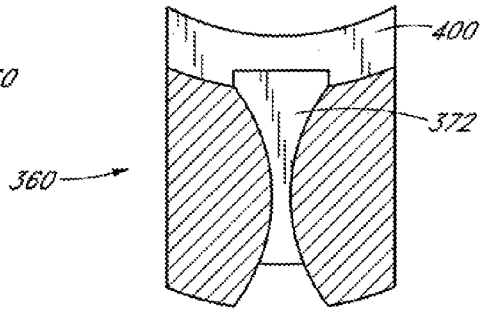

In the illustrated embodiment, a proximal end 362 of the segment 360 is provided with a beveled edge or keel 380. The geometries of the proximal and distal end can be readily interchanged, without changing the function of the resistance element. The beveled edge 380 is formed by a first bearing surface 382 and a second bearing surface 384 which incline medially in the proximal direction. The beveled edge 380 of a given segment 360 nests within a channel 386 of the adjacent segment 360. Channel 386 is formed by a first surface 388 and a second surface 400 which incline medially in a proximal direction. As will be appreciated by reference to FIGS. 26 through 29, a plurality of segments 360 under mild compression by pull wire 366 will permit lateral articulation of adjacent segments as the beveled edge 380 slides within channel 386 of the adjacent segment 360. The bearing surfaces may be provided with any of a variety of surface treatments, coatings, textures or materials to modify the sliding friction characteristics. As shown in FIG. 28, the central lumen 372 may be provided with a flared cross section in both the proximal and distal directions, to accommodate the pull wire during flexion and extension of the associated motion segment.

Figure 26:
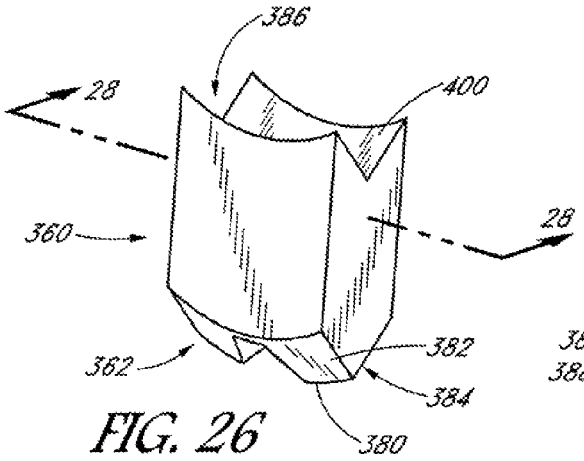
FIGS. 26-29 illustrate flat or rectangular segments in accordance with the present invention.
Figure 27:
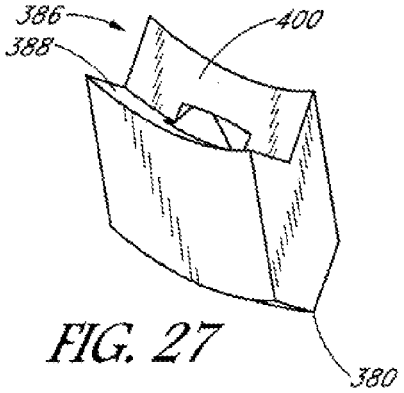
Figure 29:
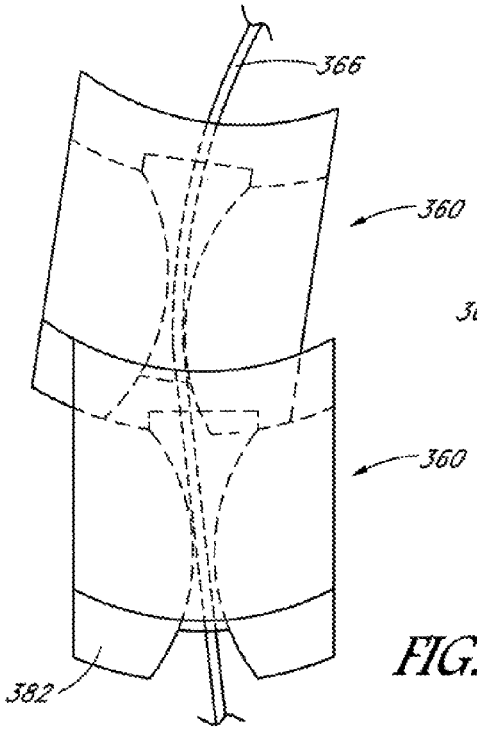

The flat or rectangular segment 360 illustrated in FIG. 26 thus substantially limits movement to flexion or extension within plane, or in shear. For this reason, resistance elements utilizing the segments of FIGS. 26 through 29 are preferably mounted on the lateral or medial sides of the garment.

Figure 30:
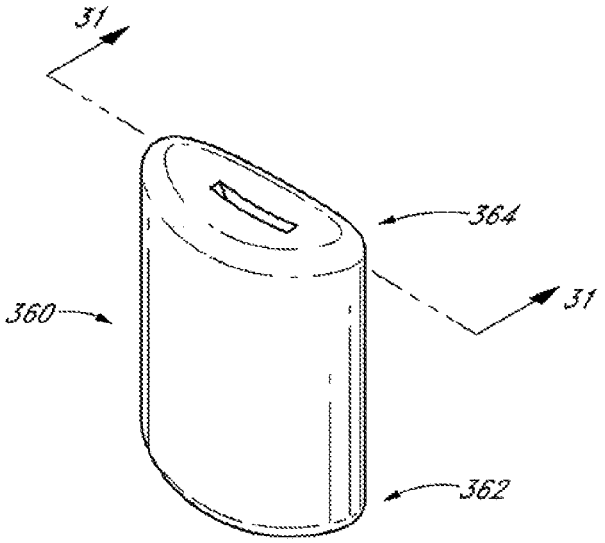
FIGS. 30-32 illustrate oval segments in accordance with the present invention.
Figure 32:
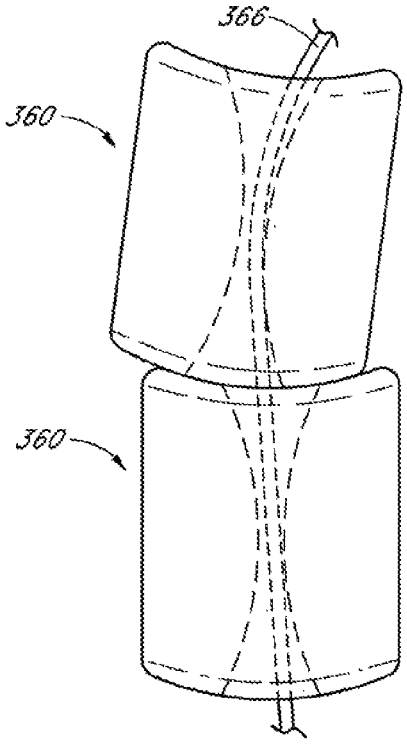
Figure 31:
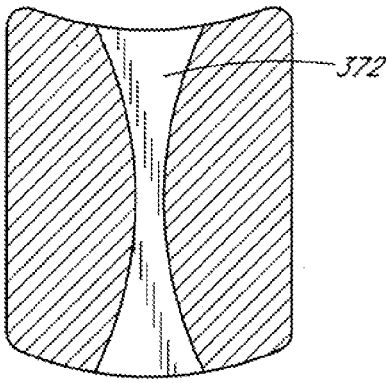

The segment 360 may alternatively be provided with a substantially oval or rounded configuration, as illustrated in FIGS. 30 through 32.

Figure 33:
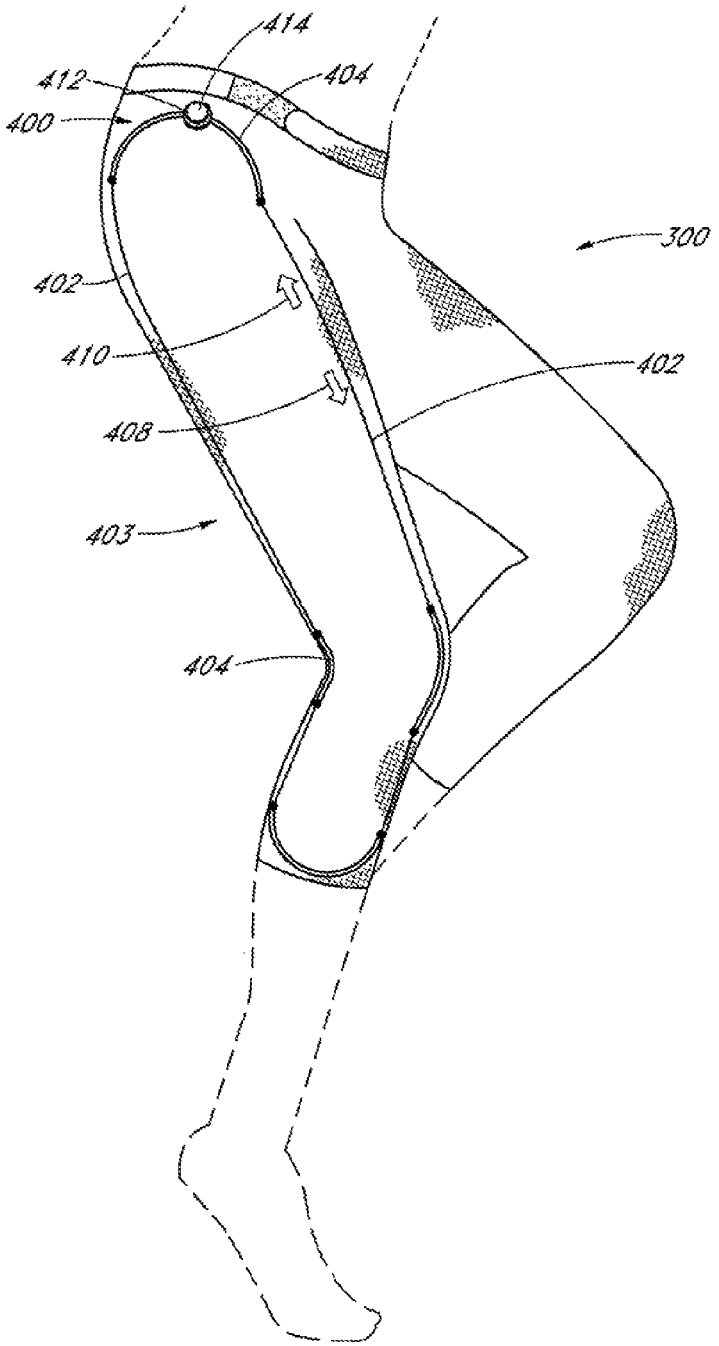
FIG. 33 is a side elevational view of a pulley and/or cable embodiment of a resistance system in accordance with the present invention.

Referring to FIG. 33, there is illustrated a schematic view of a cable system 400. As used herein, the term cable refers to any of a variety of elongate flexible elements, which exhibit relatively low elongation under tension in the intended use environment. The cable may comprise a single stand or multi-strand construct, comprising string, polymeric filament or metal wire. The cable may be woven, braided or twisted, in a multi-strand embodiment, which may have more desirable flexibility characteristics than a single strand cable. Metal cables may comprise any of a variety of materials, such as stainless steel, or preferably Nitinol.

In the illustrated embodiment, a cable 402 extends up the posterior surface 403 of the garment, through a guide structure such as guide to 404, and back down the anterior surface of the garment. The posterior and anterior aspects of the cable may be joined at the inferior limit, to form an endless loop, or may otherwise be anchored or secured with respect to the garment. The superior aspect of the cable 402 is freely sideable through the guide tube 404. In this manner, the anterior aspect of the cable will move in a first direction 408 under flexion, and a second direction 410 under extension.

Resistance to movement is provided by adding resistance to movement of the cable 402 within its path. Resistance may be accomplished simply by the tortuosity or characteristics of the cable path, including the guide tubes 404. Alternatively, a resistance element 412 may be provided within the cable path, such as at the superior aspect as illustrated. The resistance element may comprise any of a variety of mechanisms for controllably resisting movement of the cable therethrough, such as compression of a brake element against the cable 402. Brake element may comprise a surface having a material such as nylon, Teflon, polyethylene or other brought into compression against the cable such as by an adjustable screw. Alternatively, the cable may wind around a drum, and the drum may include any of a variety of resistance brakes, or gear trains, including a fly wheel, to provide controlled resistance to the cable moving therethrough. The pulley or drum which rotates in response to reciprocal movement of the cable may be utilized to turn a generator, which can be utilized to charge a battery or capacitor or drive an electronic device. This allows the wearer to recapture some amount of mechanical energy in the form of electrical energy.

The path of the cable 402 can take any of a variety of configurations as will be understood by those of skill in the art. As has been previously discussed, the resistance across the hip may desirably be greater than the resistance across the knee, which may make it desirable to have two or more cable loops per leg as will be apparent in view of the disclosure herein. Guide tubes 404 or other guide structures such as pulleys, pins, pegs, fabric sleeves or the like may be provided and arranged as appropriate for a particular garment design. The resistance element may provide a preset resistance level, determined at the point of manufacture. Alternatively, the resistance element may be provided with a knob 414 or other control permitting user adjustability of the resistance level. Adjustability may be accomplished by tightening or loosening the compression of a brake shoe against the cable, or using a clutch structure such as the mechanism in a "star drag" feature well understood in the fishing reel arts.

What is claimed is:

1. A bidirectional, neutral bias toning garment, comprising:

a first attachment structure, for attachment with respect to a first region of a human body;

a second attachment structure, for attachment with respect to a second region of a human body which is movable throughout an angular range with respect to the first region;

a resistance element between the first and second attachment structures;

wherein the resistance element imparts bidirectional resistance in response to movement between the first and second regions of a human body, throughout a range of motion, but imparts no directional bias in the absence of motion between the first and second regions of the human body; and wherein the resistance to movement is maintained within a range between a minimum of at least about 0.5 foot pounds and a maximum which is less than about 3 times the minimum.

2. A bidirectional, neutral bias toning garment as in claim 1, wherein the first attachment structure comprises a structure for attachment to a leg above a knee.

3. A bidirectional, neutral bias toning garment as in claim 1, wherein the first attachment structure comprises a structure for attachment at a waist.

4. A bidirectional, neutral bias toning garment as in claim 1, wherein the resistance element comprises a pivotable resistance element.

5. A bidirectional, neutral bias toning garment as in claim 1, wherein the first attachment structure and the second attachment structure comprise first and second regions of a garment.

6. A bidirectional, neutral bias toning garment as in claim 5, wherein the garment extends at least from a waist to below a knee.

7. A bidirectional, neutral bias toning garment as in claim 1, wherein the bidirectional, neutral bias toning garment extends at least from a waist to a calf.

8. A bidirectional, neutral bias toning garment as in claim 6, wherein the garment imposes a first level of resistance to movement across a hip and a second level of resistance across a knee, and the first level is greater than the second level.

9. A bidirectional, neutral bias toning garment as in claim 1, wherein the resistance element is removably carried by the bidirectional, neutral bias toning garment.

10. A bidirectional, neutral bias toning garment as in claim 1, comprising a plurality of sleeves for receiving resistance elements.

11. A bidirectional, neutral bias toning garment as in claim 1, wherein the garment comprises a left leg having a left resistance element and a right leg having a right resistance element.

12. A bidirectional, neutral bias toning garment as in claim 1, wherein the garment comprises a compression fabric.

13. A bidirectional, neutral bias toning garment as in claim 12, wherein the fabric comprises a polyester elastane fabric with moisture wicking properties.

14. A bidirectional toning garment as in claim 9, wherein the garment comprises a compression fabric.

15. A bidirectional toning garment as in claim 14, wherein the fabric comprises a polyester elastane fabric with moisture wicking properties.

16. A bidirectional toning garment as in claim 14, wherein the left and right resistance elements each impose a resistance of at least about 0.5 foot pounds.

17. A bidirectional toning garment as in claim 16, wherein the left and right resistance elements each impose a resistance of at least about 1 foot pound.

18. A bidirectional toning garment as in claim 1, wherein the maximum is less than about 2 times the minimum.

* * * * *